US008718501B2

(12) United States Patent
Aoki

(10) Patent No.: US 8,718,501 B2
(45) Date of Patent: May 6, 2014

(54) IMAGE FORMING APPARATUS CAPABLE OF MINIMIZING REVERSE TONER TRANSFER

(75) Inventor: Shinji Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 395 days.

(21) Appl. No.: 13/064,750

(22) Filed: Apr. 13, 2011

(65) Prior Publication Data

US 2011/0255892 A1 Oct. 20, 2011

(30) Foreign Application Priority Data

Apr. 16, 2010 (JP) ..... 2010-094790

(51) Int. Cl.
*G03G 15/16* (2006.01)

(52) U.S. Cl.
USPC ..... 399/66

(58) Field of Classification Search
USPC ..... 399/66, 298, 299, 302, 303
See application file for complete search history.

(56) References Cited

U.S. PATENT DOCUMENTS

| | | | | |
|---|---|---|---|---|
| 5,640,645 | A | 6/1997 | Namekata et al. | |
| 5,918,086 | A * | 6/1999 | Nakano et al. | 399/66 |
| 6,658,220 | B2 * | 12/2003 | Bessho et al. | 399/44 |
| 7,639,976 | B2 * | 12/2009 | Yoshida | 399/302 |
| 8,238,773 | B2 * | 8/2012 | Usami et al. | 399/66 |
| 2009/0123168 | A1 | 5/2009 | Aoki et al. | |
| 2010/0098446 | A1 | 4/2010 | Ishikawa et al. | |
| 2010/0232820 | A1 | 9/2010 | Usami et al. | |
| 2010/0284705 | A1 | 11/2010 | Aoki et al. | |
| 2011/0058831 | A1 | 3/2011 | Usami et al. | |
| 2011/0200348 | A1 * | 8/2011 | Aoki | 399/66 |
| 2012/0224873 | A1 * | 9/2012 | Aoki | 399/66 |

FOREIGN PATENT DOCUMENTS

| | | | |
|---|---|---|---|
| JP | 2704277 | A | 5/1990 |
| JP | 03065975 | A * | 3/1991 |
| JP | 05181373 | A | 7/1993 |
| JP | 05-210279 | | 8/1993 |
| JP | 06289682 | A | 10/1994 |
| JP | 3340221 | A | 7/1995 |
| JP | 07-225520 | | 8/1995 |
| JP | 08083006 | A | 3/1996 |
| JP | 10078691 | A * | 3/1998 |
| JP | 10268674 | A | 10/1998 |
| JP | 2002372834 | A * | 12/2002 |
| JP | 2003186284 | A | 7/2003 |
| JP | 2004-226868 | | 8/2004 |
| JP | 2008-089740 | | 4/2008 |

OTHER PUBLICATIONS

Abstract of JP H08-083006 published Mar. 26, 1996.
Abstract of JP 07-175340 published Jul. 14, 1995.

(Continued)

*Primary Examiner* — Robert Beatty
(74) *Attorney, Agent, or Firm* — Harness, Dickey & Pierce, P.L.C.

(57) ABSTRACT

In an image forming apparatus, a determiner determines a target amount of transfer current based on first and second algorithms each representing a relation between an image area rate of a latent image bearer in the vicinity of an exit of a transfer nip and a target amount of transfer current to be provided to a nip creating member. The first algorithm is utilized in a second transfer step when the image area rate falls within a typical range from the lower limit (a %) to the upper limit (b %). The first algorithm decreases the target amount as the image area rate increases within that range.

8 Claims, 12 Drawing Sheets

(56) References Cited

OTHER PUBLICATIONS

Abstract of JP 2003-186284 published Jul. 3, 2003.
Abstract of JP H10-268674 published Oct. 09, 1998.
Abstract of JP H06-289682 published Oct. 18, 1994.
Abstract of JP H05-181373 published Jul. 23, 1993.
Abstract of JP 02-123385 published May 10, 1990.
Japanese Office Action for corresponding Japanese Application No. 2010-094790 dated Nov. 22, 2013.

* cited by examiner

IMAGE FORMING APPARATUS CAPABLE OF MINIMIZING REVERSE TONER TRANSFER

CROSS REFERENCE TO RELATED APPLICATIONS

This application claims priority pursuant to 35 USC §119 to Japanese Patent Application No. 2010-094790, filed on Apr. 16, 2010, the entire contents of which are hereby incorporated by reference herein.

BACKGROUND OF THE INVENTION

1. Field of the Invention

The present invention relates to an image forming apparatus, such as a copier, a facsimile machine, a printer, etc., and in particular to an image forming apparatus capable of determining an amount of transfer current supplied to a transfer nip in accordance with an image area rate of a latent image bearer in the vicinity of the transfer nip.

2. Description of the Background Art

An image forming apparatus capable of determining an amount of transfer current supplied to a transfer nip is described in Japanese Patent Application Laid Open No 8-83006. Such an image forming apparatus includes only one combination of a photoconductor and a transfer roller that contacts the photoconductor and creates a transfer nip therebetween, thereby forming a monochrome image on a recording sheet. A transfer bias having a polarity opposite to that of a normal charge of toner is applied to the transfer roller. A toner image on the photoconductor is transferred receiving the transfer bias onto a recording sheet launched into the transfer nip. A background not subjected to optical writing and a latent image section subjected thereto are each charged on the surface of the photoconductor in the same polarity as the normal charge polarity of the toner. A potential of the background is higher than that of the latent image section. As a result, a prescribed amount of a current is supplied between the transfer roller and the photoconductor due to separation electric discharge caused at an exit of the transfer nip therebetween. Specifically, a greater amount of current flows into the background due to having a higher potential than that of the latent image section on the photoconductor.

In such a situation, when an image area rate of a photoconductor is relatively low in the vicinity of an exit of the transfer nip, a greater amount of a current needs to be supplied from a power source than when it is relatively high. Because, if not, a prescribed amount of a current cannot be supplied to the latent image section, and accordingly a transfer problem of uneven image density occurs in accordance with the image area rate. Then, the image forming apparatus changes an output target amount of a current as time elapses to be supplied from the power source in accordance with the image area rate in the vicinity of the exit of the transfer nip to obtain stable image density regardless of the image area rate.

An image forming apparatus capable of forming a color image by superimposing toner images during transfer steps is known and described in Japanese Patent Application Laid Open No 2003-186284 (JP-2003-186284-A). Specifically, multiple toner images borne on latent image bearers, such as photoconductors, etc., are superimposed on a transfer member, such as an intermediate transfer member, etc., using various known techniques.

For example, the image forming apparatus of JP-2003-186284-A employs a tandem system to execute the superimposition of toner images. For this purpose, the image forming apparatus includes four photoconductors separately forming toner images of Y to Bk (magenta to black) monochrome colors. An intermediate transfer belt is employed contacting the photoconductors, to form primary transfer nips therebetween for the Y to Bk colors, respectively. Specifically, the Y toner image on the Y color photoconductor is transferred in the M color primary transfer nip onto the intermediate transfer belt in the Y color primary transfer nip. The M toner image on the M color photoconductor is transferred onto the Y color toner image borne on the intermediate transfer belt. Subsequently, C and Bk color toner images are similarly transferred and superimposed on the Y and M color toner images on the intermediate transfer belt in their primary transfer nips, respectively. A full-color image is finally formed on the intermediate transfer belt when such superimposition is completed in the transfer steps.

Another known type of an image forming apparatus includes a photoconductor, four developing devices for separately developing latent images formed on the photoconductors with toner of Y to Bk colors and superimposing the images on an intermediate transfer belt. Specifically, such an image forming apparatus forms toner images of different colors from each other on the photoconductor and superimposes those on an intermediate transfer belt with each rotation thereof to generate a color image on the intermediate transfer while circulating the belt about four times.

In the above-described systems, image density possibly fluctuates in accordance with an image area rate as in a monochrome type image forming apparatus as described in Japanese Patent Application Laid Open No 8-83006 (JP-8-83006-A). An experiment is performed using a tandem type color printer test machine on condition that a target amount of an output current supplied from each of primary transfer power sources of respective colors of Y to Bk is changed in accordance with an image area rate of a photoconductor of each of the respective colors. It is then confirmed that toner images of respective colors can be efficiently transferred onto an intermediate transfer belt from the photoconductors during their primary transfer processes. However, a significant amount of a toner image borne on the intermediate transfer belt is transferred reversely to a background section of the photoconductor in their downstream side primary transfer nip. For example, a large amount of a Y toner image is preferably transferred onto the intermediate transfer belt in the Y color primary transfer nip, but is transferred reversely on to backgrounds of the photoconductors in the other colors in their downstream side primary transfer nips. Similarly, a significant amount of an M color toner image on the intermediate transfer belt is transferred reversely onto backgrounds of the photoconductors of C and Bk colors in their downstream side primary transfer nips, respectively. Yet further, a C color toner image on the intermediate transfer belt is transferred reversely onto a background of the photoconductor of a Bk color in the downstream side primary transfer nip.

It is revealed that such reverse transfer is prominent when a region only including a background or a remarkably small image area rate (collectively referred to as a large image background region) among the entire region of the photoconductor in its rotational direction is positioned at the downstream side of the exit of the transfer nip.

However, such reverse transfer has not been induced in a conventional tandem type image forming apparatus even though the large area background region is positioned at the exit of the transfer nip. That is, the conventional tandem type image forming apparatus provides a prescribed constant transfer current regardless of an image area rate of the photoconductors. Specifically, when a large area background region of the photoconductor enters a transfer nip, a prescribed amount of a current flows in the transfer nip between the photoconductor and a belt, and accordingly a potential of the belt decreases. As a result, a potential difference between the background of the large area background region of the photoconductor and the intermediate transfer belt becomes smaller at the exit of the transfer nip, and electric discharge is hardly induced therebetween.

By contrast, a target amount of transfer current is changed in the above-described color printer testing machine to minimize fluctuation of image density caused in accordance with a change in an image area rate on a photoconductor in the vicinity of an exit of a transfer nip as in the past. Accordingly, when a large area background region of a photoconductor is positioned at the exit, the output target amount necessarily needs to be increased extraordinarily. As a result, electric discharge is actively induced between the photoconductor and the belt at the transfer nip exit thereby causing serious reverse transfer of the toner.

The similar problem possibly occurs in a circulation type image forming apparatus as in the above-described tandem type. Because, when second and subsequently color toner images are transferred onto the intermediate transfer belt at transfer nips during second and subsequently circulations thereof after transferring of a first color toner image thereonto, the toner on the belt is possibly transferred back onto a background of the photoconductor at a transfer nip exit.

SUMMARY OF THE INVENTION

Accordingly, an object of the present invention is to provide a new and novel image forming apparatus including a determiner determines a target amount of transfer current based on first and second algorithms each representing a relation between an image area rate of a latent image bearer in the vicinity of an exit of a transfer nip and a target amount of transfer current to be outputted to a nip creating member. A process controller is provided to execute a first transfer step, in which the toner image on the latent image bearer is transferred onto one of the nip creating member and the recording sheet for the first time, and a second transfer step, in which the toner image on the latent image bearer is transferred onto one of the nip creating member and the recording sheet already carrying a prescribed toner image thereon. The first algorithm is utilized in the second transfer step when the image area rate falls in a typical range from the lower limit (a %) to the upper limit (b %). The first algorithm decreases the target amount as the image area rate increases within the typical range. The second algorithm is utilized in a second transfer step when an image area rate is less than the lower limit (a %) of the typical range. The second algorithm decreases the target amount to be less than that obtained by the first algorithm when the image area rates is the lower limit (a %). The lower limit (a %) is more than zero and the higher limit (b %) is greater than the lower limit (a %).

In another aspect, a third algorithm is utilized in the second transfer step when the image area rate is more than the upper limit (b %). The third algorithm increases the target amount obtained by the first algorithm when the image area rate is the upper limit (b %), wherein said upper limit (b %) is less than 100%.

In yet another aspect, the second algorithm increases the target amount as the image area rate increases.

In yet another aspect, the third algorithm increases the target amount as the image area rate increases.

In yet another aspect, a combination of said second and third algorithms causes a target amount corresponding to 0% to be less than that corresponding to 100%.

In yet another aspect, a combination of said first to third algorithms causes the target amount corresponding to 0% to be the least.

In yet another aspect, a prescribed one of the first and second algorithms is used in the first transfer step to decrease a target amount as the image area rate increases in a range from zero to 100%.

In yet another aspect, the second algorithm associates a smaller target amount in a second transfer step than that in the first transfer step with the same image area rate.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
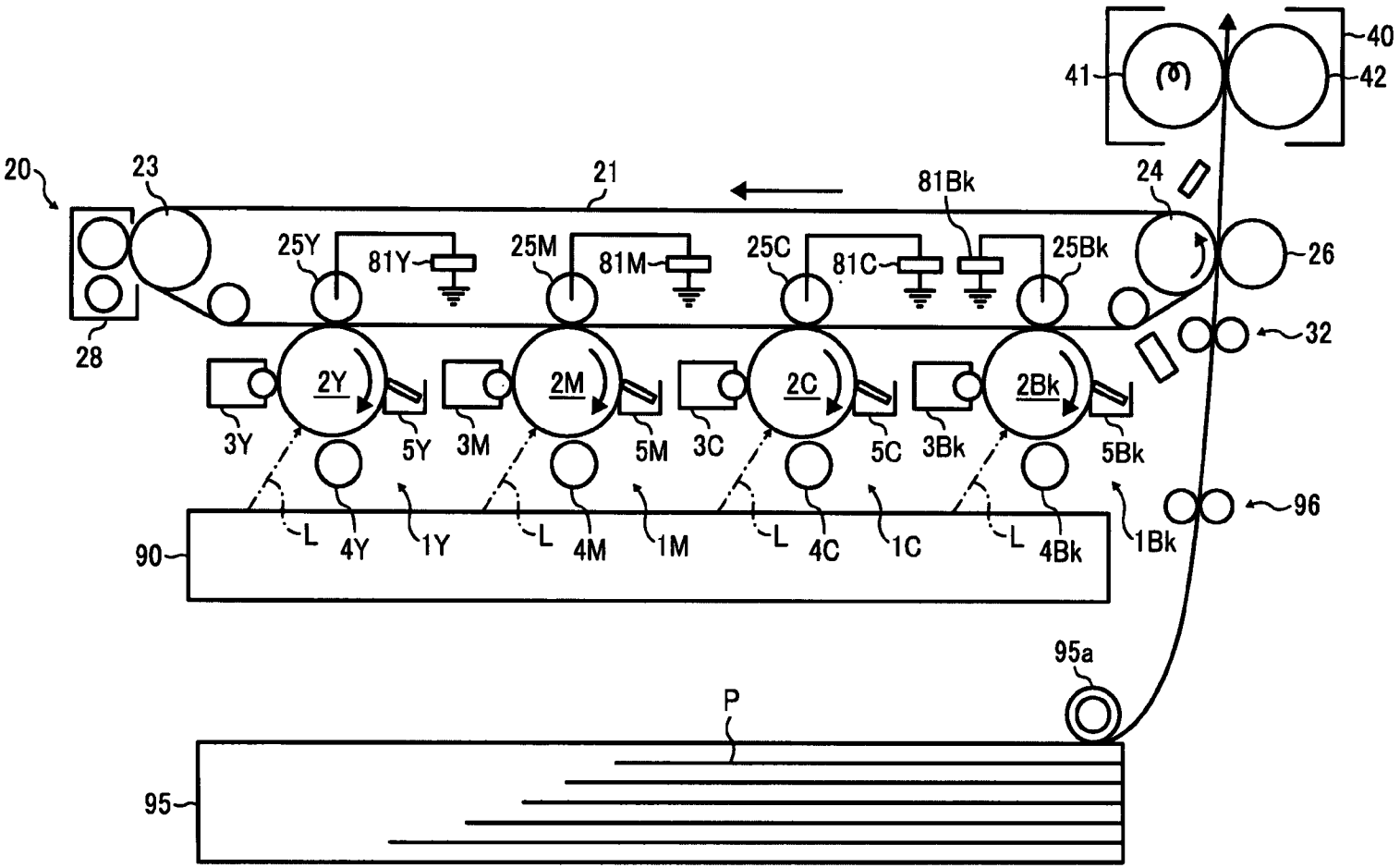
FIG. 1 schematically illustrates an exemplary configuration of a printer according to one embodiment of the present invention.

Referring now to the drawings, wherein like reference numerals designate identical or corresponding parts throughout several views, in particular in FIG. 1, an exemplary color printer that forms a color image using a tandem type image formation section according to one embodiment of the present invention is described.

As shown, the printer includes four process units 1Y to 1Bk for Yellow, Magenta, Cyan, and Bk colors as toner image formation devices.

These process units 1Y to 1Bk employ Y to Bk toner particles, respectively, and include substantially the same configurations to each other.

A process unit 1Y forming a Y toner image typically includes a photoconductor 2Y, a developing device 3Y, a charger, and a photoconductor cleaner 5Y or the like and holds these devices in a unit on a holder detachably attached to a printer body.

The charger includes a charge roller 4Y either contacting or being provided in the vicinity of the photoconductor 2Y. The charge roller 4Y is driven and rotated by a driver, not shown. A prescribed charge bias is applied to the charge roller 4Y from a charge power source, not shown. By generating electric discharge between the charge roller 4Y and the photoconductor 2Y, a surface of the photoconductor 2Y is uniformly charged having the same polarity to that of normal charge of toner. Instead of such a charge system, a scolorotron charge can be employed.

The photoconductor 2Y includes a drum having a diameter of 30 mm coated with an organic pc layer on its surface. An electrostatic capacity of the photoconductor 2Y is controlled to be about 9.45E−7(F/m$^2$), and is driven and rotated clockwise in the drawing by a driver, not shown. The surface of the photoconductor 2Y is exposed to a laser light emitted from an optical writing unit 90 described later and carry a latent image thereof for Y color.

The developing device 3Y stores developer including Y toner and magnetic carrier, not shown. The developing device 3Y includes an opening on its casing through which a circumferential surface of a cylindrical developing sleeve is partially exposed opposing the surface of the photoconductor 2Y. A magnet roller, not shown, is provided being free from rotation of the developing sleeve therein, so that the developing sleeve carries the developer in the casing receiving magnetic force thereof. As being rotated and driven, the developing sleeve conveys the developer to a developing station opposing the photoconductor 2Y. In the developing device, a developing bias is applied to the developing sleeve and a developing potential operates toward the photoconductor 2Y to move the Y toner having a negative polarity from the sleeve to the photoconductor.

Further, between the developing sleeve and a background of the photoconductor 2Y, a non-image potential operates to move the Y toner having the negative polarity from the photoconductor to the sleeve. Thus, the Y toner in the developer moves to the latent image on the photoconductor 2Y owing to the above-described developing potential in the developing station.

Thus, the photoconductor 2Y is developed to be a Y toner image.

The developing device 3Y includes a toner density sensor, not shown, to determine toner density of the developer inside. A detection result of the toner detection sensor is transmitted to a controller, not shown, as a voltage signal. The controller includes a RAM to store a target amount of an output voltage to be outputted from the toner detection sensor. The controller compares the target amount with an output voltage from the toner detection sensor, and drives a toner supplier, not shown, for Y color for a prescribed time period in accordance with the comparison result. During such driving, an appropriate amount of Y toner particles is supplied to the developer whose Y toner density decreases owing to its consumption as development proceeds, so that the toner density of the developer in the developing device 3Y can be maintained within a prescribed range. The same toner supply control is practiced for each of the developing devices of the other colors 3M to 3Bk.

The same configurations are employed in the other process units 1M to 1Bk for other colors, and thus toner images of colors of M to Bk are formed on the photoconductors 2Y to 2Bk, respectively. The latent images are then developed by the developing units 3Y to 3Bk to be toner images of M to Bk colors. A toner particles adhered amount per unit area of an absolutely solid image formed on a photoconductor is about 0.45 (mg/cm$^2$).

An optical writing unit 90 is disposed below the process units 1Y to 1Bk as a latent image formation device. The optical writing unit 90 emits a laser light generated in accordance with image information onto a uniformly charged surface of the photoconductors 2Y to 2Bk. A potential of a laser light exposed section on the photoconductors 2Y to 2Bk deteriorate and are lower than those of backgrounds surrounding thereto, thereby providing latent images of Y to Bk colors.

The optical writing unit 90 emits the laser light generated by the light source to the photoconductors 2Y to 2Bk via multiple optical lenses and mirrors while deviating it with a polygon mirror driven and rotated by a motor. However, an LED array can be employed instead of the above described device.

Above the process units 1Y to 1Bk there is provided a transfer unit 20 having an endless intermediate transfer belt 21 rotated counter clockwise in the drawing contacting the process units 2Y to 2Bk via its lower stretching surface for forming primary transfer nips for Y to Bk colors. Toner images of Y to Bk colors formed on the photoconductors 2Y to 2Bk are superimposed onto the intermediate transfer belt 21 at respective primary transfer nips of different colors.

Toner remaining on the surfaces of the respective photoconductors 2Y to 2Bk after passing through the primary transfer nips of Y to Bk colors are removed therefrom by photoconductor cleaners 5Y to 5Bk.

Below the optical writing unit 90, there is provided a sheet feeding cassette 95. In the sheet feeding cassette 95, there is accommodated a stack of recording sheets P as a recording medium in a bundle state with their uppermost recording sheet P being contacting a sheet feeding roller 95*a*. When the sheet feeding roller 95*a* is driven and rotated counter clockwise in the drawing by a driver, not shown, the uppermost recording sheet P is ejected onto a sheet feeding path vertically extending on the right side of the sheet feeding cassette 95. The recording sheet P launched into the sheet feeding path is conveyed upwardly from a lower side in the drawing. A process line velocity of each of the photoconductors 2Y to 2Bk and the intermediate transfer belt 21 is 120 (mm/sec).

At the end of the sheet feeding path, there is provided a pair of registration rollers 32 that immediately temporarily stop rotating when pinching the recording sheet P. The pair of registration rollers 32 sends off the recording sheet P at a prescribed time toward a secondary transfer nip described later.

The transfer unit 20 includes primary transfer rollers 25Y to 25Bk, a driven roller 23, and a secondary transfer opposing roller 24 or the like beside the intermediate transfer belt 21. Further included in the transfer unit 20 are a secondary transfer roller 26 inside a belt loop and a belt clear 28 and the like.

A thickness of the intermediate transfer belt 21 is about 80 microm and the intermediate transfer belt 21 includes an endless substrate made of conductive polyimide resin, into which carbon is dispersed, to serve as a nip creating member. A cubic resistance rate is 1E9 (ohm×cm) when measured by Hiresta UP Model MCP-HT450 manufactured by Mitsubishi Chemical Co, Ltd with 100 v bias. The intermediate transfer belt 21 is endlessly rotated counter clockwise in the drawing by one of rollers stretching the intermediate transfer belt 21 therearound.

The four primary transfer rollers 25Y to 25Bk press the intermediate transfer belt 21 against the photoconductors 2Y to 2Bk to create primary transfer nips in which the intermediate transfer belt 21 contacts the photoconductors 2Y to 2Bk. The primary transfer rollers 25Y to 25Bk each includes a metal rotation shaft and an elastic sponge roller made of resin into which ion conductive agent is dispersed overlying the metal shaft. A cubic resistance rate of the conductive sponge roller is about 5E8 (ohm×cm). The metal rotation shaft is deviated downstream from the rotation shaft of the photoconductor in a belt moving direction by about 3 mm.

A primary transfer bias having an opposite polarity to a charge polarity of toner is applied to each of the primary transfer rollers 23Y to 23Bk from each of the corresponding primary transfer power sources 81Y to 81Bk. Consequently, a transfer electric field drawing the toner image from the photoconductor to the belt is created in the primary transfer nip. The toner images Y to Bk colors on the photoconductors 2Y to 2Bk are superimposed on the front surface of the intermediate transfer belt 21 as endlessly moving through the primary nips for Y to Bk colors one by one, so that a four color superimposed toner image are formed thereon.

A secondary transfer opposing roller 24 provided inside the belt loop sandwiches the intermediate transfer belt 21 with the second transfer roller 26, so that a secondary transfer nip where the front surface of the intermediate transfer belt 21 contacts the secondary transfer roller 26 is formed on the right side of the belt in the drawing. The above-described pair of registration rollers 32 pinching the recording sheet P sends off the recording sheet P at a prescribed time capable of synchronizing with the four color toner image carried on the intermediate transfer belt 21 toward the secondary transfer nip.

A secondary transfer bias having an opposite polarity to that of the toner is applied to the secondary transfer roller 26. Thus, the four color superimposed toner image on the intermediate transfer belt 21 is transferred at once onto the recording sheet P in the secondary transfer nip receiving the secondary transfer bias and a nip pressure, and is made into a full color toner image on the recording sheet P having a blank.

Toner not transferred onto the recording sheet P remains downstream of the secondary transfer nip on the intermediate transfer belt 21 after the transfer process, but is removed by the belt cleaner 28. Specifically, the belt cleaner 28 has a cleaner roller contacting the front side of the intermediate transfer belt 21 to electrostatically transfer the toner remaining after the transfer process on the intermediate transfer belt.

Above the secondary transfer nip, there is provided a fixing unit 40. The fixing unit 40 forms a fixing nip by contacting a fixing roller 41 having a heat generator, such as a halogen lamp, etc., with the pressing roller 42 pressing against the fixing roller 41. The recording sheet P passing through the secondary transfer nip is conveyed into the fixing unit 40 when separated from the intermediate transfer belt 21. Then, by receiving heat and pressure during conveyance from the lower side to the upper side while being pinched in the fixing nip in the fixing unit 40, the full color trig is fixed.

Hence, the recording sheet P subjected to the fixing process and sent off from the fixer 40 is ejected outside by a pair of sheet ejection rollers, not shown.

Figure 2:
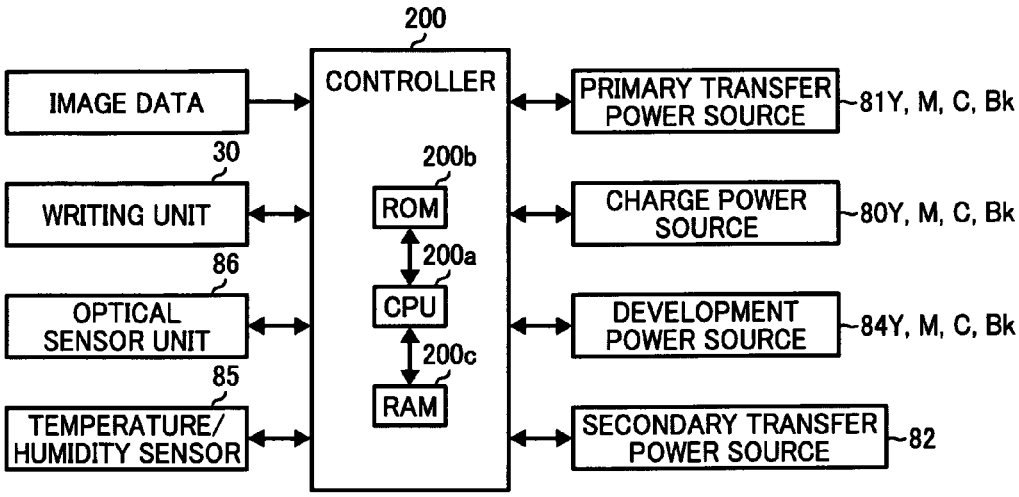
FIG. 2 is a block chart schematically partially illustrating exemplary electrical circuitry included in the printer of FIG. 1.

Now, an exemplary electric circuit of the printer is described with reference to FIG. 2. As shown, a controller 200 includes a CPU (Central Processing Unit) 200*a* as a calculator, a RAM (Random Access Memory) 200*c* as a non-volatile memory, and a ROM (Read Only Memory) 200*b* as a temporary storage and the like. Although only a part of instruments is illustrated in the drawing, the controller 200 generally controls an apparatus while connecting to various instruments and sensors. The controller 200 controls driving of each of instruments based on control program stored in the RAM 200*c* and the ROM 200*b*. Further, the controller 200 determines a primary transfer current of each of Y to Bk colors in accordance with image data (i.e., a writing signal in an exposure process) transmitted from an externally located personal computer or the like. The controller 200 then controls the primary transfer power sources 81Y to 81Bk for Y to Bk colors so that thus determined primary transfer current is produced. Such a controller 200 serves as a transfer current outputting device together with the primary transfer power sources 81Y to 81Bk. Further, a target amount of the primary transfer current to be outputted from each of the primary transfer power sources 81Y to 81Bk is outputted from the controller 200 as a PWM signal and is inputted to each of those.

Figure 3:
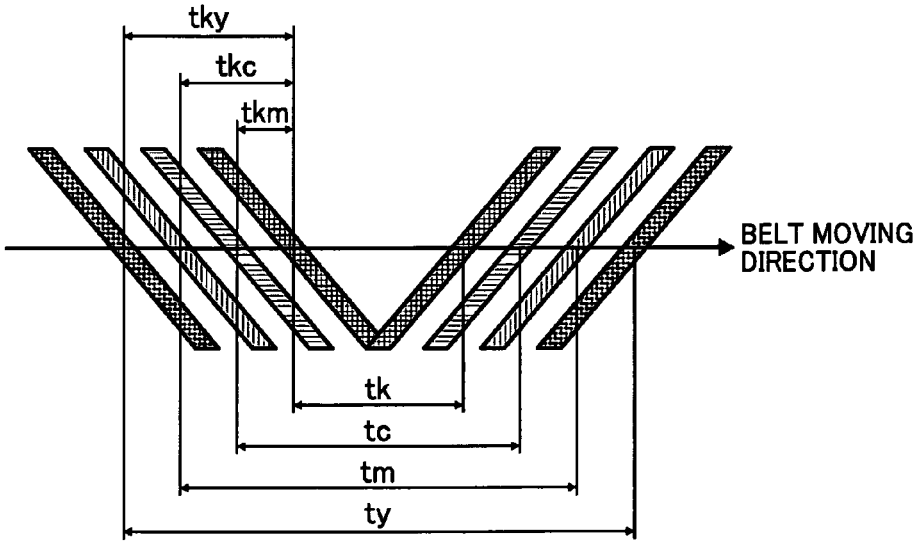
FIG. 3 is an enlarged pattern diagram, illustrating exemplary chevron patches.

Further, the controller 200 executes a position deviation amount correction process every immediately after a main power source switch, not shown, is turned ON or every when a prescribed number of sheets has been printed, in which multiple toner images of chevron patches PV shown in FIG. 3 are formed on the intermediate transfer belt 21 as positional deviation detection images. The optical sensor unit 86 of FIG. 2 leads a light emitted from a light emitter through a collimating lens and reflect on a surface of the intermediate transfer belt 21 and receives the light with its own light receiver, so as to output a voltage in accordance with an amount of light intensity. When a toner image in the chevron patch PV formed on the intermediate transfer belt 21 passes right below the optical sensor unit 86, a light intensity received by the optical sensor unit 86 significantly changes. Thus, the optical sensor unit 86 serves as an image detector in combination with the controller 200. An LED generating a light intensity capable of obtaining a reflection light capable of detecting the toner image is employed as the light generator. As the light reception, a CCD composed of a liner alignment of multiple light receiving elements is employed.

Thus, the controller section 200 detects a position of each of the toner images in the sub scanning direction (i.e., a belt movement direction) by detecting the toner image in the chevron patch on the intermediate transfer belt 21. The chevron patch includes a line pattern group having patches of respective Y to Bk colors aligned in the sub scanning direction inclining at an angle of 45 for example from a main scanning direction (i.e., a direction in which a laser light scans a surface of a photoconductor) at a prescribed pitch (interval). A difference in time between a Bk toner image and each of the other toner images are detected is read for each of the Y to M color toner images in the chevron patch PV. In the drawing, an up and down direction corresponds to the main scanning direction. Thus, Y to Bk toner images are aligned from the left in this order, and are then aligned in the opposite order from the Bk to Y toner images by changing their posture by the angle of 90 degree. Then, a device amount of the respective color toner images in the sub scanning direction is sought based on practical amounts Then, based on the positional deviation, a time when the optical writing unit starts optical writing with regard to the photoconductor is corrected to reduce positional deviation of each color toner image, which caused by velocity fluctuation of one of the photoconductor and intermediate transfer belt 21.

Back to FIG. 1, a Y toner image on the photoconductor 2Y is initially transferred onto the intermediate transfer belt 21 at the primary transfer nip of Y color located upstream most in the sub scanning direction for the first time among the primary transfer nips of Y to Bk colors. Specifically, a first transfer step is executed at the Y primary transfer nip without executing superimposition of toner image transfer. By contrast, in the M to Bk primary transfer nips, second and subsequent transfer steps are executed onto one or more toner images already transferred onto the intermediate transfer belt 21 to superimpose thereof.

Each of primary transfer power sources 81Y to 81Bk outputs and provides a prescribed transfer current equivalent to a target amount of each color to the intermediate transfer belt 21, which serves as a nip creating member, via each of primary transfer rollers 25Y to 25Bk of Y to Bk colors.

Figure 4:
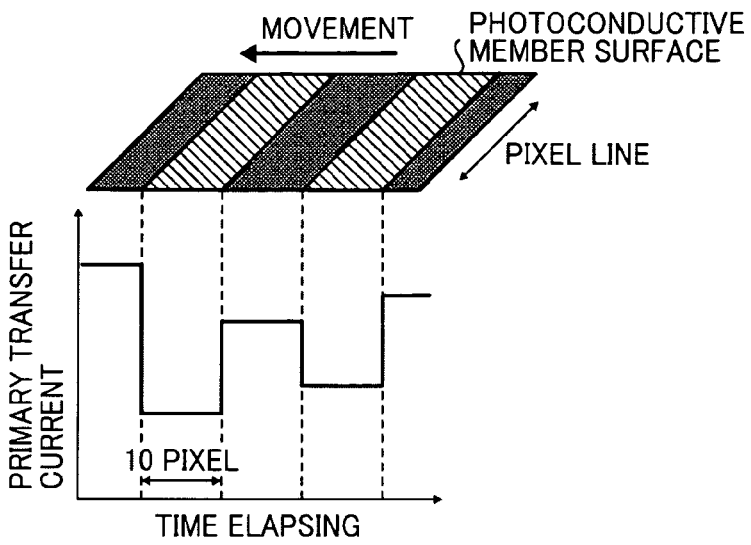
FIG. 4 is a pattern diagram illustrating exemplary ten-line compartment on a photoconductor.

These target amounts of the transfer currents are each determined in accordance with an image area rate of a toner image on the photoconductor at a transfer nip exit and in the vicinity thereof. Specifically, the surface of the photoconductor is logically divided into plural regions in the sub scanning direction each having 10 pixels (a 10 line compartment) in the direction from a leading end of a page as a reference as shown in FIG. 4. In each of compartments (i.e., a 10 line compartment), there are provided 10 pixel lines each formed from pixels linearly aligning in the main scanning direction. In each of the pixel lines, a number of pixels (i.e., a latent image section) is counted and divided by to the maximum number of pixels to obtain an image area rate. Then, an average of image area rates of ten pixel lines in the ten line compartment is calculated to obtain an average image area rate. The target amount of the primary transfer current is determined as a level corresponding to the average of image area rates of ten line compartment just passing through the transfer nip exit among others. Thus, when the ten line compartment is passing through the primary transfer nip exit, an output voltage from each of the primary transfer power sources 81Y to 81Bk is adjusted to be equivalent to the target amount thus determined. When the downstream most pixel lime in the ten line compartment has passed through the transfer nip exit, a target amount of transfer current supplied from each of the primary transfer power sources 81Y to 81Bk is changed to a level corresponding to an average image area rate of the next ten line compartment.

That is, a current flowing between the photoconductor and the intermediate transfer belt 21 is caused substantially by a separation electric discharge generated when the photoconductor and the intermediate transfer belt 21 are separated from each at the primary transfer nip exit. When an image area rate of a photoconductor is relatively low while the primary transfer power source (81Y to 81Bk) supplies a small amount of current to the primary transfer nip exit, the current supplied from the primary transfer power source is almost spent by the separation electric discharge caused therebetween. Consequently, transfer error occurs substantially due to absence of current to be supplied to the latent image section of the photoconductor. However, by flowing transfer current in accordance with the average image area rate in the latent image section of the photoconductor in the vicinity of the primary transfer nip exit, a difference in potential between the latent image section of the photoconductor and the belt can be minimized less than an electric discharge start voltage.

Now, an exemplary image formed on a recording sheet is described with reference to FIG. 5. The recording sheet in this example in the drawing is a plain paper of A4 size (JIS) conveyed in the sub scanning direction in the printer and the primary transfer nip as shown by an arrow A. A band state image having a width of 29.7 mm in the main scanning direction (left and right direction) extending in the sub scanning direction is formed on the recording sheet. A width of the recording sheet of A4 size is 297 mm. Since the image extends over the entire region in the sub scanning direction, the image area rate is constantly 10% regardless of a position in the sub scanning direction. Thus, when such an image is outputted, the average image area rates in a ten-line compartment entering the primary transfer nip is always 10%. Accordingly, a prescribed constant primary transfer current is continuously outputted from leading and trailing ends of the image as different from a current waveform as fluctuating in FIG. 4.

Figure 5:
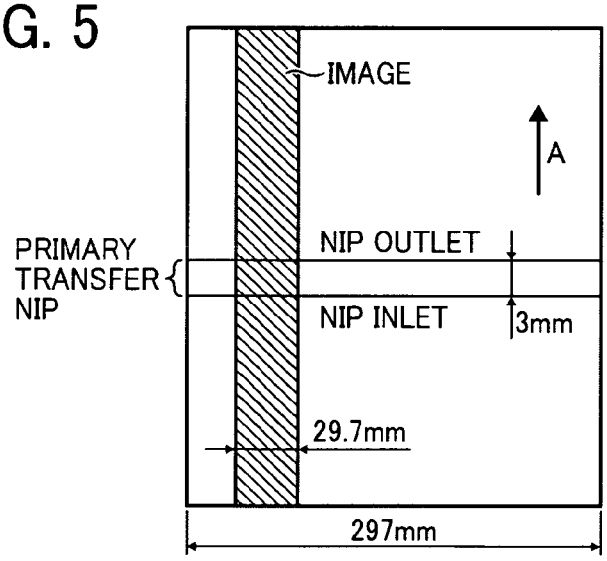
FIG. 5 is a pattern diagram illustrating an exemplary recording sheet and an image formed thereon.
Figure 6:
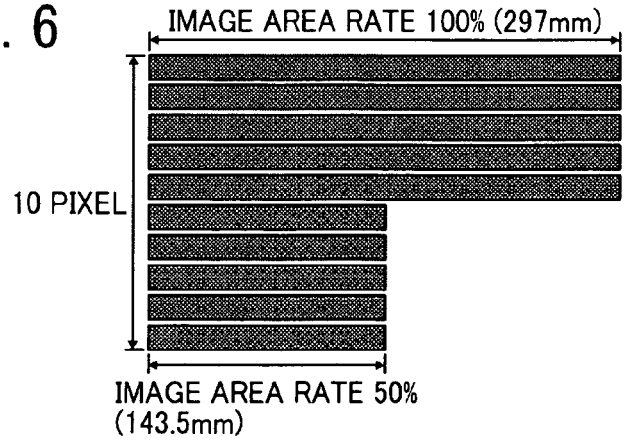
FIG. 6 is a partially enlarged pattern diagram illustrating an image different from that in FIG. 5.

Another image to be formed having a different shape from that of FIG. 5 is illustrated in FIG. 6. A width of the image is not constant in the main scanning direction, and fluctuates depending on a position in the sub scanning direction. In an image region, an image area rate of each of first to fifth pixel lines from the leading end in the sub scanning direction among the ten pixel lines is 100%. By contrast, an image area rate of each of five pixel lines on the trailing end side among the ten pixel lines is 50%. Since an average image area rate becomes 75% in the 10 line compartment, a target amount of the primary transfer current is determined corresponding to the average amount of 75%. In this example, the average image area rate is calculated based on a laser writing signal used in the optical writing unit 90.

Now, an exemplary result of experiment executed using a test machine having almost the same configuration as the above-described printer illustrated FIG. 1 is described herein below. In this test, three types of test images are outputted, and a primary transfer current, a primary transfer voltage, a primary transfer rate, and a reverse transfer rate are investigated for each type.

As one of test images among three types, a rectangle shape Bk color test image having a length of 14.85 mm in the main scanning direction extending over the entire region in the sub scanning direction (along a lengthwise direction of A4 size sheet (JIS)) is printed with an image area rate 5%. At that time, a Bk color primary transfer power source 81Bk is subjected to constant voltage control to output a prescribed constant voltage. A control target amount of the voltage is gradually increased by 100V step by step from 1000 to 2300 Voltages, while the Bk 5% test image is printed at every control target amounts. Then, an amount of current outputted from the Bk color primary transfer power source 81Bk is detected per printing. Further, a toner attracted amount in a Bk 5% test image per unit area on a Bk color photoconductor 2Bk before entering the Bk color primary transfer nip and that after passing through the Bk color primary transfer nip are detected. Then, a primary transfer rate is obtained as a rate of a difference between the former and latter toner attracted amounts to the former toner attracted amount.

As one of the other test images, a test image attracting Bk color toner to the whole area region of A4 size sheet (JIS) (i.e., an image area rate is 100%) is printed. As one of yet another test image, a test image attracting M color toner to the whole area region of A4 size sheet (JIS) (i.e., an image area rate is 100%) and Bk color toner? overlying thereon with an image area rate 5% is printed. To form these images, a control target amount of voltage is gradually increased by 100V step by step from 1000 to 2300 Volt, while the primary transfer current amount and the primary transfer rate are detected at every control target amounts as executed in the Bk 5% test image formation. Further, in the testing of the M100% and Bk5% test image, an amount of M toner transferred back onto a background of the photoconductor 2Bk when passing through the Bk color primary transfer nip is detected. Then, an M toner reverse transfer rate is obtained by calculating a rate of the detected amount to an amount of M toner before the test image enters the nip. Such a toner attracted amount is detected based on spectroscopic measurement executed with a reflective spectroscopic density meter X-Rite 938.

Now, a relation between a primary transfer voltage, a primary transfer current, and a test image, that between a primary transfer rate, a primary transfer voltage, an M toner reverse transfer rate, and a test image, as well as a primary transfer rate, a primary transfer current, an M toner reverse transfer rate, and a test image are described with reference to FIGS. 7 to 9, respectively.

Figure 7:
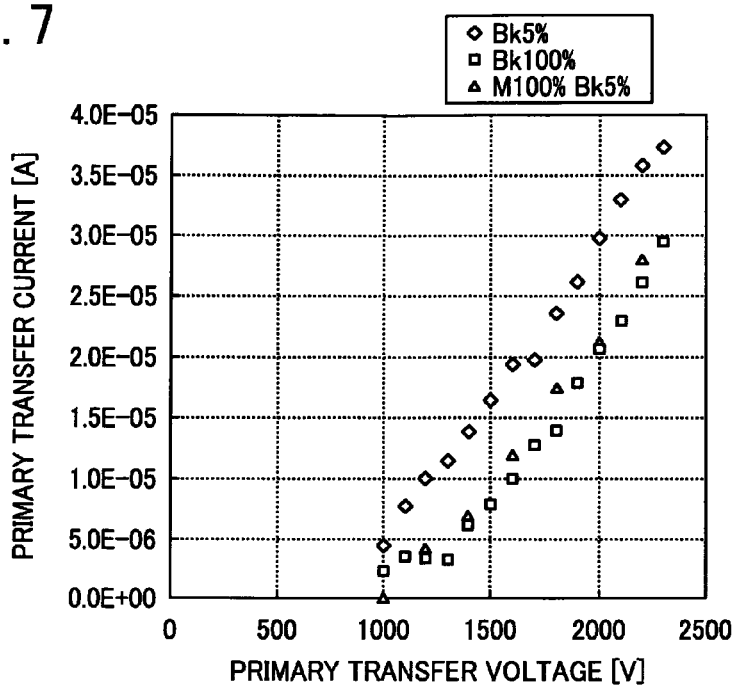
FIG. 7 illustrates an exemplary relation between a primary transfer voltage, a primary transfer current, and a test image obtained through an experiment.
Figure 8:
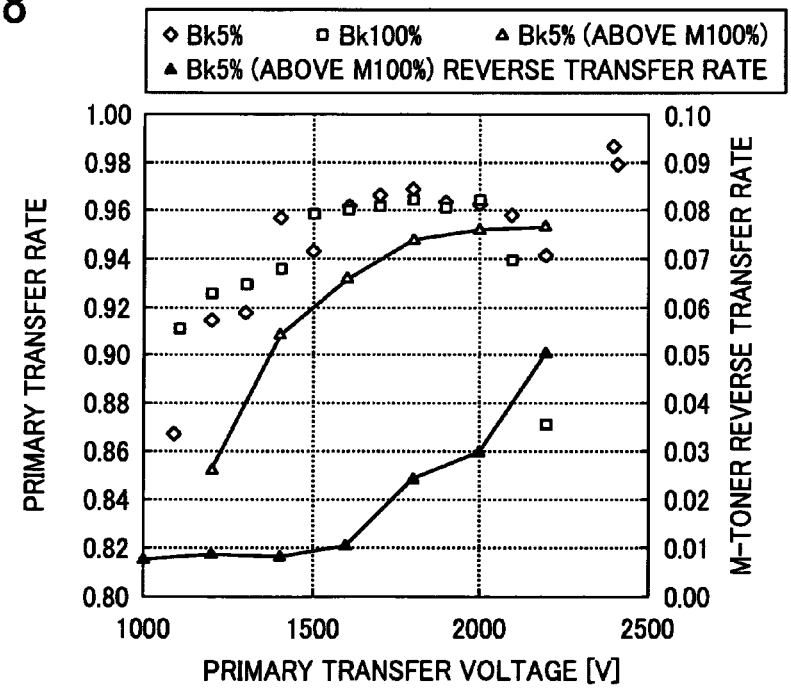
FIG. 8 illustrates an exemplary relation between a primary transfer rate, the primary transfer voltage, a reverse transfer rate of M toner, and the test image obtained in the experiment.
Figure 9:
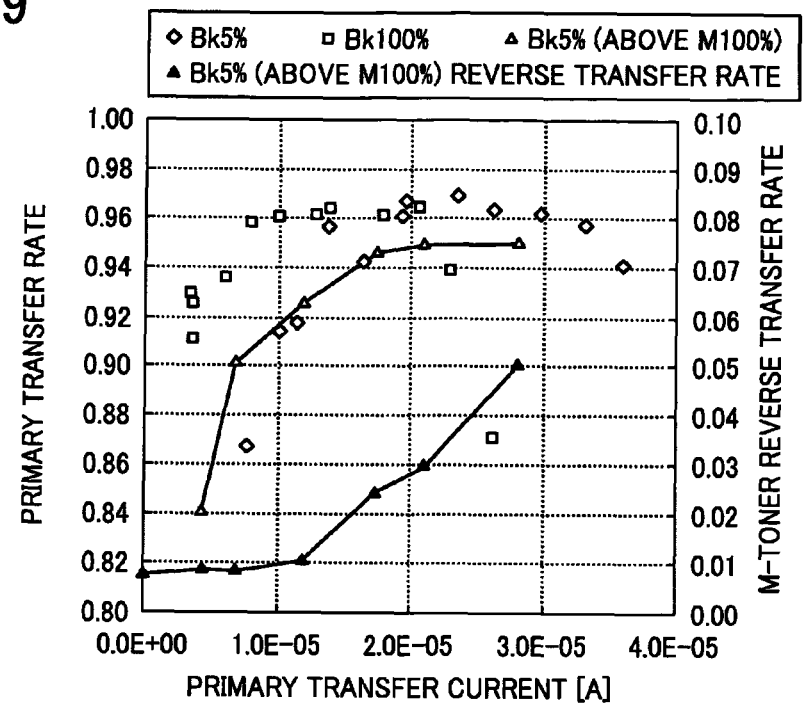
FIG. 9 illustrates an exemplary relation between the primary transfer rate, the primary transfer current, the reverse transfer rate of M toner, and the test image obtained in the experiment.

Specifically, as shown in FIG. 8, when a test image having only a Bk monochrome toner image is formed (e.g. Bk 5% or Bk 100%), and a primary transfer voltage exceeds a prescribed level, especially 2000 volt, the primary transfer rate starts sharply dropping regardless of the image area rate. As shown in FIG. 7, in the condition of 2000 volt, an amount of a current flowing through the primary transfer nip changes in accordance with the image area rate. Specifically, when the Bk5% test image is formed on the condition that the primary transfer voltage is 2000 volt, the primary transfer power source 81Bk outputs a primary transfer current of 30 micro Ampere.

Whereas when the Bk100% test image is formed on the condition that the primary transfer voltage is 2000 volt, the primary transfer power source 81Bk outputs a primary transfer current of 21 micro Ampere. Thus, when the primary transfer bias is subjected to constant voltage control, a greater amount of transfer current is supplied as the image area rate on the photoconductor decreases. That is, under the condition of the constant voltage control in that the primary transfer voltage is controlled to be a prescribed constant level, an amount of electric charge quantity of electric charge on the photoconductor increases and a greater amount of current is supplied between the belt and the photoconductor as the image area rate decreases.

For example, a charger uniformly charges the photoconductor 2Bk of Bk color with about −500 volt in the printer test machine. Then, such potential of −500 volt is attenuated to about −30 volt when a laser light L is emitted thereto. Since having an electrical capacitance of about 9.5E−7(F/cm$^2$), the photoconductor 2Bk has an area electric charge density of about −475 micro C/m$^2$ in its background. Whereas an area electric charge density of a latent image section on the photoconductor 2Bk is the sum of an electric charge amount calculated by the follow formula and that (−29 microC/m$^2$) of a remaining potential (about −30 volt) on the photoconductor, thereby becoming about −119 microC/m$^2$;

$$0.45E-3[\text{g/cm}^2]\times-20[\text{micro C/g}] = -0.009[\text{micro C/cm}^2]$$
$$= -90[\text{micro C/cm}^2]$$

On the photoconductor 2Bk, the electric charge amount of the background is about four times as much as the latent image section. Thus, in the primary transfer nip, an electric field created between the latent image on the photoconductor 2Bk and the intermediate transfer belt 21 is more intensive than that created between the background of the photoconductor 2Bk and the intermediate transfer belt 21. As a result, since a current becomes readily flowing between the belt and the photoconductor, an output current amount increases to obtain a prescribed output voltage of the primary transfer power source 81Bk.

Hence, the smaller the image area rate, the more the output current supplied from the power source in the constant voltage control. However, even though the image area rate is the same, the primary transfer current amount largely changes depending on environment. That is, when the environment changes, a resistance of the intermediate transfer belt or the printer 25Bk fluctuates accordingly. Thus, even though the target amount of the optical voltage is changed in accordance with the image area rate under the constant voltage condition, the primary transfer current becomes either excessive or insufficient and sometime causes transfer error depending on the environment. Thus, the primary transfer bias is preferably subjected to constant current control rather than the constant voltage control. More preferably, the target amount of the primary transfer current is changed in accordance with the image area rate not simply being subjected to the constant current control.

A prescribed target amount of the primary transfer current is preferably employed to increase transfer efficiency in the primary transfer nip of Y color as much as possible. That is, the Y color toner image gradually and slightly loses toner due to attraction of the toner to a photoconductor every when passing through all of the primary transfer nips of M to Bk colors and tends to be thinner than others. Then, the target amount of the output current from the primary transfer power source 81Y is preferably increased as much as possible so that transfer efficiency can be maximum. In this experiment, the maximum transfer efficiency is obtained under the condition that ambient is about 25 degrees centigrade and the primary transfer voltage is about 2000 volt. Further, when the Bk 5% test image is formed, the primary transfer current of about 30 micro Ampere is supplied as shown in FIG. 7. Whereas when the Bk 100% test image is formed, the primary transfer current of about 21 micro Ampere is supplied. When a constant voltage control is simply executed and room temperature changes from 25 degree centigrade and a resistance of either a belt or a roller changes, the primary transfer current becomes either excessive or insufficient, even though the primary transfer voltage is maintained at 2000 volt. Because, the amount of 2000 volt enables obtaining of the maximum transfer efficiency when the room temperature is 25 degree centigrade. Accordingly, when the environment changes from the temperature, such condition also changes. By contrast, the current condition capable of obtaining the maximum transfer efficiency is constant regardless of the environment. Specifically, when the image area rate is 5%, the maximum transfer efficiency is achieved by maintaining the primary transfer current of 30 micro Ampere. Further, when the image area rate is 100%, the maximum transfer efficiency is achieved by maintaining the primary transfer current of 100 micro Ampere.

Hence, by changing a target amount of an output current of the primary transfer power source 81Y in accordance with an image area rate, the maximum transfer efficiency can be maintained. However, it is realized that when the similar constant current control is executed for the remaining primary transfer power sources 81M to 81Bk, Y toner on the belt is readily transferred back onto backgrounds of the photoconductors 2M to 2Bk at the primary transfer nips of M to Bk colors, respectively.

For example, as shown in FIG. 8, depending on an amount of a primary transfer voltage, a reverse transfer rate of M 100% toner image borne on the belt to the background of the photoconductor 2Bk (M toner image reverse transfer rate) necessarily becomes extraordinarily high in the Bk color primary transfer nip. Specifically, under the condition where the primary transfer voltage is from about 1000 to about 1500 volt, the M toner reverse transfer rate stays less than 0.001%. However, when the primary transfer voltage is equal of more than 1600 volt, the M toner reverse transfer rate immediately increases sharply Specifically, the transfer efficiency starts sharply decreasing when the primary transfer voltage exceeds 2000 volt, because a potential difference between a latent image section having −30 volt on the photoconductor and the intermediate transfer belt 21 exceeds an electric discharge start voltage when the primary transfer voltage exceeds 2000 volt. Then, electric discharge largely occurs between the latent image section having −30 volt on the photoconductor and the intermediate transfer belt 21 in the primary transfer nip, and accordingly toner on the latent image section is reversely charged by the electric discharge. Due to the reverse charging, the toner on the latent image section does not electrostatically move to the intermediate transfer belt 21 and stays on the latent image, thereby decreasing the transfer efficiency.

When the transfer efficiency decreases, electric discharge occurs not only between the latent image having −30 volt on the photoconductor and the belt, but also between the background of the photoconductor having −500 volt and the belt. However, when a monochrome image is printed, since a toner image on the photoconductor is transferred onto an intermediate transfer belt 21 alone not together with any other color toner images in the primary transfer nip, toner does not intervene between the background of the photoconductor and the belt. Accordingly, the electric discharge occurred between the background and the belt is not prominent.

Now, a latent image section having −30 volt on the photoconductor, where transfer efficiency prominently decreases is focused. When an output voltage from the primary transfer power source is increased to a level more than 2000 volt, a potential difference between the latent image section on the photoconductor and the belt is necessarily increased to that more than an electric discharge start level. Since a surface potential of the belt is difficult to recognize, an output voltage from the primary transfer power source is considered hear for the sake of simplicity.

When a potential difference between the output voltage and the photoconductor is greater than 2030 volt, a potential difference between the photoconductor and the belt becomes greater than the electric discharge start voltage.

As described earlier, when an output voltage from the Bk color primary transfer power source 81Bk is increased to a level more than 1600 volt in this experiment, an M toner reverse transfer rate starts sharply increases, because when a multicolor image is printed by superimposing more than two monochrome colors, a toner image already transferred on the belt intervenes between a background of each of downstream photoconductor and the belt in second and subsequent primary transfer nips. At that moment, a potential difference between the background having −500 volt on a photoconductor and an output voltage from the primary transfer power source is greater than 2030 volt, electric discharge occurs between the background section and intermediate transfer belt 21. Further, such electric discharge causes reverse discharge of toner in the toner image already transferred onto the intermediate transfer belt 21 and is transferred back onto the background of the applicable photoconductor. Since the potential of the background section of the photoconductor is −500 volt, when the output voltage from the primary transfer power source is greater than 1530 volt, the above-described reverse transfer is induced. Since the output voltage is increased by a unit of 100 volt, the condition of 1530 is met when 1600 volt is designated. Thus, it is considered that the M toner reverse transfer rate sharply increases when the primary transfer voltage exceeds 1600 volt as shown in a graph of FIG. 8.

As described earlier, when the room temperature is 25 degree centigrade and a primary transfer current of 30 micro Ampere is supplied when a 5% image is formed or that of 21 micro Ampere is supplied when a 100% image is formed, the primary transfer voltage of about 2000 volt enables the maximum transfer efficiency. However, when the same primary transfer current control is applied for each of the remaining primary power sources 81M to 81Bk at respective primary transfer nips of M to Bk colors, since a potential difference between the background of the photoconductor and the intermediate transfer belt becomes greater than the discharge start voltage in each of the respective primary transfer nips, toner on the belt is transferred back onto the backgrounds of the photoconductors from the belt.

Now, an exemplary distinguishing feature of the printer according to one embodiment of the present invention is described. As described earlier, a toner image tends to be transferred back in the primary transfer nips of M to Bk colors where the primary transfer processes are practiced. Whereas a toner image is not transferred back in the primary transfer nip of Y color where only the first transfer step is practiced. Therefore, a target amount of a primary transfer current for the primary transfer power source 81Y is decreased within a prescribed voltage range not degrading the primary transfer efficiency as an average image area rate of a ten line compartment in the vicinity of the nip exit increases. Specifically, the controller 200 calculates a target amount IY(×1) of a primary transfer current of the primary transfer power source 81Y based on the average image area rate of the ten line compartment on the photoconductor 2Y in the vicinity of the nip exit using the below described formula;

$$IY(\times 1) = -8.00 \times \times 1/100 + 28.0\ [\mu A] (0 \leq \times 1 \leq 100) \quad (1)$$

The first formula is determined with reference to FIGS. 7 and 8 to be a linear function indicating a target amount capable of obtaining a high transfer efficiency of Y toner while assigning about 1900 volt to the primary transfer voltage regardless of an average image area rate on the photoconductor in the vicinity of the nip exit. Hence, by changing and flowing a sufficient amount of primary transfer current between the latent image section of the photoconductor 2Y and the intermediate transfer belt 21 in the first transfer nip of Y color in accordance with the average image area rate ×1, primary transfer efficiency can be preferable.

When electric discharge occurs between the latent image section of the photoconductor 2Y and the intermediate transfer belt 21 at each of the outlets of the primary transfer nips of M to Bk colors where the secondary transfer steps are practiced, toner on the belt is reversely charged in a positive polarity opposite a normal charge thereof, and is transferred back onto the background of the photoconductor.

When the average image area rate in the vicinity of the transfer nip exit is less than a %, which serves as a boarder between the large area background region and others and accordingly a large area background region of the photoconductor enters the transfer nip exit, and a target amount is determined based on the first formula, an output amount of a primary transfer bias applied from each of the primary transfer power sources 81M to 81Bk is extraordinarily increases. As a result, the potential difference between the background of the photoconductor and the belt at the transfer nip exit exceeds the electric discharge start voltage, and accordingly, electric discharge readily occurs therebetween.

Thus, a target amount of a primary transfer current for each of primary transfer nips of M to Bk colors is calculated using a different formula from that used for Y color primary transfer nip. Specifically, the printer utilizes an average image area rate of 5% as a % and regards a photoconductor region (i.e., a 10-line compartment) having an average image area rate of less than 5% as a large area background region where reverse transfer especially highly likely occurs.

Further, the printer utilizes an average image area rate of 95% as b % that serves as a boarder between an extremely large area background region and others. Then, the printer regards a photoconductor region (i.e., a 10-line compartment) having an average image area rate of more than 95% as the extremely large area background region of almost a whole area solid section. The controller 200 then calculates a target amount IM(×2) of a primary transfer current supplied from the primary transfer power source 81M based on the average image area rate of the ten line compartment on the photoconductor 2M in the vicinity of the nip exit using the below described formulas;

$$IM(\times 2)=220\times\times 2/100+15.0\ [\mu A](0\leq\times 2<5) \quad (2)$$

$$IM(\times 2)=-7.89\times\times 2/100+26.4\ [\mu A](5\leq\times 2\leq 95) \quad (3)$$

$$IM(\times 2)=22.1\times\times 2/100+20.0\ [\mu A](95<\times 2\leq 100) \quad (4)$$

The controller 200 also calculates a target amount IC(×3) of a primary transfer current based on an average image area rate of a ten line compartment on the photoconductor 2C in the vicinity of the nip exit using the below described formulas for the C color primary transfer power source 81C;

$$IC(\times 3)=180\times\times 3/100+15.0\ [\mu A](0\leq\times 3\leq 5) \quad (5)$$

$$IC(\times 3)=-7.37\times\times 3/100+24.4\ [\mu A](5<\times 3\leq 95) \quad (6)$$

$$IC(\times 3)=52.6\times\times 3/100-32.6\ [\mu A](95<\times 3\leq 100) \quad (7)$$

Similarly, the controller 200 calculates a target amount IBk(×4) of a primary transfer current using the following formulas based on an average image area rate ×4 of a ten line compartment on the photoconductor 2K in the vicinity of the nip exit for the Bk color primary transfer power source 81K;

$$IC(\times 4)=180\times\times 4/100+15.0\ [\mu A](0\leq\times 4\leq 5) \quad (8)$$

$$IC(\times 4)=-7.37\times\times 4/100+24.4\ [\mu A](5<\times 4\leq 95) \quad (9)$$

$$IC(\times 4)=52.6\times\times 4/100-32.6\ [\mu A](95<\times 4\leq=100) \quad (10)$$

As understood when compared, fifth to seventh formulas and eighth to tenth formulas of respective C and Bk colors of linear functions, each representing a relation between a target amount and an average image area rate, employ the same inclination and section with each other.

The second, fifth, and eighth formulas of respective M, C, and Bk colors are low area rate algorithms employed when the average image area rates (×2 to ×4) are each less than 5%, accordingly a large area background region of a photoconductor is positioned at each of exits of primary transfer nips.

Further, third, sixth, and ninth formulas of respective M, C, and Bk colors are first algorithms each employed when the average image area rate is from about 5 to about 95%.

Further, the fourth, seventh, and tenth formulas of respective M, C, and Bk colors are third algorithms each employed when the average image area rate is more than 95%, accordingly an extremely large image region of a photoconductor is positioned at each of exits of primary transfer nips.

Now, an exemplary relation between a target amount of a primary transfer current and an average image area rate in the vicinity of the nip exit of each of the respective colors obtained based on the first to tenth formulas is described with reference to FIG. 10. When focusing on target amounts of primary transfer current of Y and M colors, the followings are revealed. When the average image area rate is the same to each other in the image are range less than 95%, the latter target amount is smaller than the former target amount. Because, since the primary transfer nip of Y color always serves as the first transfer step, and accordingly none of toner images has been transferred onto the belt prior thereto, toner is not transferred back at the transfer nip exit from the belt onto a background of the photoconductor 2Y. Therefore, by only focusing on obtaining excellent transfer efficiency, the inclination and the section of the first formulas are determined to be −8.00 and 28.0, respectively.

By contrast, the primary transfer nip of M color possibly serves both of the first and second transfer steps. Specifically, when a primary transfer process of a Y color toner image is not executed and none of toner images is carried on an intermediate transfer belt 21, and a primary transfer process of an M color toner image is then executed thereon, such a primary transfer process of M color serves as the first transfer step. Whereas when a primary transfer process of an M color toner image is executed onto the intermediate transfer belt 21 already carrying a toner image of Y color transferred in the Y color primary transfer nip, the primary transfer process of M color serves as a second transfer step. Then, in such a second transfer step, the Y toner particle carried on the belt is possibly transferred back onto a background of the photoconductor 2M at the exit of the primary transfer nip of M color. Therefore, not only focusing on obtaining an excellent transfer efficiency, but also considering the reverse transfer, the inclination and the section of the third formulas are determined.

Accordingly, when an average image area rate is the same to each other, a target amount IM(×2) of M color is smaller than a target amount IY(×1) of Y color in the range of from 5 to 95%. When an average image area rate is the same to each other, a target amount IM(×2) of M color is smaller than a target amount IC(×3) of C color or a target amount IBk(×4) of Bk color in the same range. Because, since M toner particle exists on the intermediate transfer belt 21 in addition to Y toner particle in the primary transfer nips of Y and Bk colors, a greater amount of toner particles exist than that in the primary transfer process of M color only having the Y toner particle. For this reason, toner is more readily transferred back in the Y and Bk color nips than in the primary transfer nip of M color.

Figure 10:
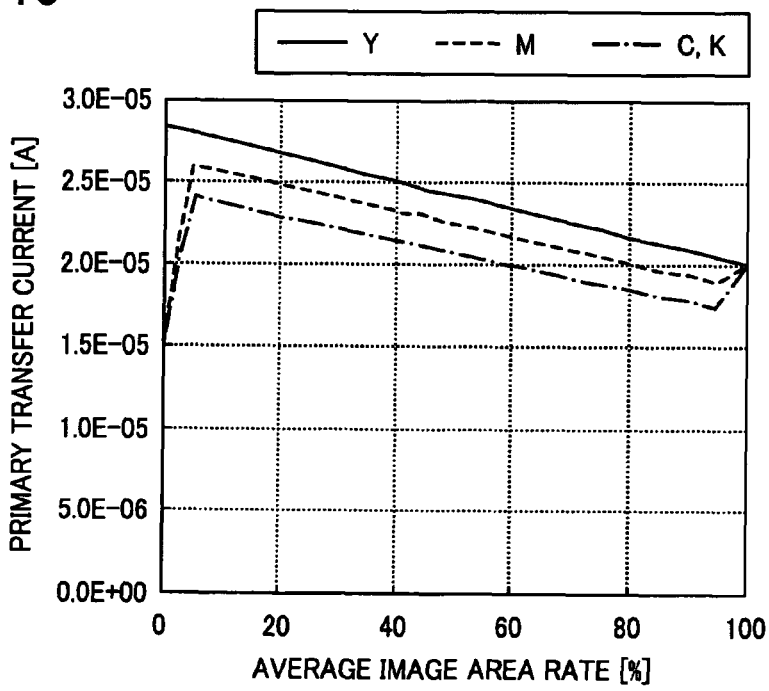
FIG. 10 illustrates a first exemplary relation between a target amount of a primary transfer current and an average image area rate per color.

As understood from the second and subsequent transfer steps of the M, C, and Bk colors with reference to FIG. 10, each of inclinations of liner functions is negative when an average image area rate ranges from about 5 to about 95%, and is positive when ranging less than about 5%.

This is because, almost none of toner particles are carried on a photoconductor in the vicinity of the transfer nip exit when an average image area rate on the photoconductor is extraordinarily low such as less than 5%, especially about 0%. In such a condition, a transfer device for transferring toner from a photoconductor onto a belt can be omitted, and an image quality does not deteriorate even a primary transfer bias is omitted therebetween.

When such an extraordinary small area image is not a halftone image, but is a character or line image, and accordingly few toner particles are transferred back from the character or line image, fluctuation of image density is almost not visible. When such an extraordinary small area image is a halftone image, such an image includes dot latent images each isolated from a background therearound aligning at a prescribed interval. Therefore, due to impact of a positive electric charge of the dot latent image and a potential of the surrounding background, a primary transfer current is readily supplied from the background to the latent image section. In addition, since a very small amount of toner particles is attracted to the dot latent image, the toner particle of the dot latent image can be transferred onto the intermediate transfer belt 21 without increasing the primary transfer voltage.

Further, to appropriately minimize an amount of waste toner particles of all colors of Y to Bk, it is advantageous to prioritize on decreasing an amount of reverse transfer toner particles by decreasing a primary transfer current than increasing transfer efficiency by increasing the primary transfer current. For example, when it is supposed that an average image area rate of a Y color toner image on a belt and that of a M color toner image on a photoconductor 2M are each about 2% in the vicinity of primary transfer nip of M color, a target amount of a primary transfer current for M color (i.e., IM(×2=2)) is calculated using the third formula and 26.2 micro Ampere is obtained. When it is supposed that a voltage-current performance does not substantially change from when it is from about 2% to about 5%, an output of a primary transfer voltage from a primary transfer power source of M color amounts to about 1800 volt as shown in FIG. 7, and a reverse transfer rate of Y toner and that of M toner amount to about 2.5% and 96.2%, respectively, as shown in FIG. 8.

Consequently, about 6.3% (calculated as 2.5%+3.8%) of toner is attracted to the photoconductor 2M at the primary transfer nip of M color and is lost. When sought using the second formula, IM(×2=2) becomes 19.4 micro Ampere, and the primary transfer voltage becomes 1600 volt and outputs such current as shown in FIG. 7. Further, a reverse transfer rate of Y toner becomes about 1.0% and that of M toner 95.5%, respectively, as shown in FIG. 8. Consequently, about 5.5% (as calculated as 1%+4.5%) toner is attracted to the photoconductor 2M at the primary transfer nip of M color and is lost.

Thus, an amount of waste toner particles more decreases while increasing a valid usage rate of the toner particle if it is prioritized to decrease an amount of reverse transfer toner particles by decreasing a primary transfer current, as the IM(×2=2) is obtained using the third formula. Of course, as the image area rate of Y toner on the belt increases, an output amount of a primary transfer voltage from the primary transfer power source 81M increases, and accordingly a reverse transfer rate of the Y toner increases.

Accordingly, it is understood that is it advantageous to decrease an amount of current and an amount of waste toner particles as in this printer when an average image area rate on the photoconductor is significantly low in the vicinity of the transfer nip exit.

Therefore, when an average image area rate on the photoconductor is less than 5% in the vicinity of the nip exit of the primary transfer nips of M to Bk colors, a target amount of a primary transfer current is sufficiently decreased, preferably to about 10 micro Ampere. However, when a region of a photoconductor having an average image area rate of about 10% enters a transfer nip exit, a primary transfer current is expected, but cannot sharply sufficiently increase due to a limit on an output responsibility of a power source. As a result, a transfer error possibly occurs. Then, the primary transfer current is not decreased down to 10 micro Ampere and maintains more than 15 micro Ampere. Thus, depending on the responsibility of the power source, the primary transfer current can be decreased to around 10 micro Ampere.

The inclination of the graph is positive within the range where the average image area rate is less than 5%, because as the average image area rate approaches 5% from zero %, the average image area rate highly likely slightly increases than 5% at a moment just thereafter, so that a primary transfer current needs to sharply increase up to about 26 micro Ampere.

When the average image area rate ×2 in the vicinity of the transfer nip exit ranges from about 5% to about 95%, target amounts of the primary transfer currents of IM(×2), IC(×3), and IBk(×4) increase as average image area rates decrease as calculated by the first algorithm.

Where as when an average image area rate on each of the photoconductors in the vicinity of primary transfer nips of M to Bk colors is 100%, toner of each color is attracted to an image formation maximum range thereon excluding any backgrounds at the transfer nip exit. Since it only occurs on a photoconductor background, reverse transfer does not occur when the photoconductor does not include the same even though the primary transfer current is extraordinarily increased.

However, a whole area solid image readily emphasizes unevenness of a transfer red image having insufficient density. For example, when pressure applied to both rear and front sides of an apparatus and the primary transfer nip (i.e., left and right sides on an output image) is uneven, left and right density deviation immediately becomes visible. Thus, when an average image area rate is 100%, a target amount of a primary transfer current is preferably designated higher than an ordinary level thereof to give a priory to a transfer efficiency.

When an average image area rate is not 100% but more than 95%, a target amount of a primary transfer current is again preferably designated higher than an ordinary level thereof to give a priory to a transfer efficiency. Instead of the third, the sixth, and the tenth formulas of the first algorithm, the fourth, the seventh, and the tenth formulas of the third algorithm is utilized. As a result, a graph showing a negative inclination in the range from about 5 to about 95% turns to show a positive one in the range more than 95% as shown in FIG. 10. Therefore, as the average image area rate increases, the target amount of the primary transfer current increases. Consequently, a primary transfer current is designated higher than an ordinary level thereof, and the emphasis of insufficient image density can be minimized.

Figure 11:
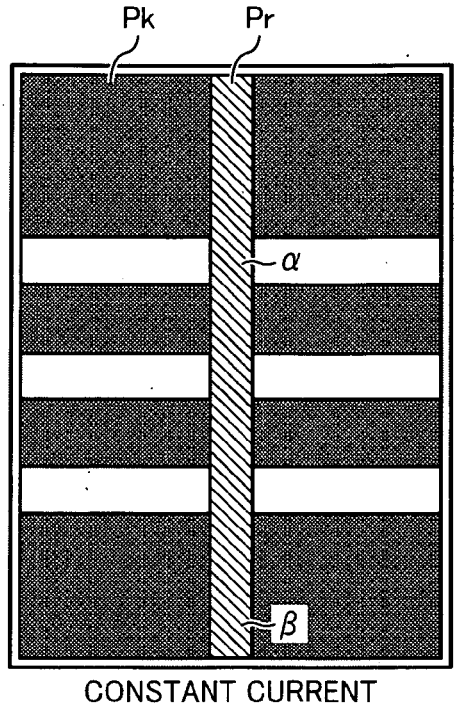
FIG. 11 is an enlarged pattern diagram illustrating an exemplary test image.

Then, an experiment of printing a test image of FIG. 11 is executed using a print testing machine having the above-described configuration, in which the test image includes black and red solid image sections Pk and Pr formed by Bk toner and mixture of Y and M toner particles, respectively.

The black solid image section Pk has an image area rate of 90% having a blank at around a center in the main scanning direction and blanks in the sub scanning direction having a prescribed length at a prescribed interval.

Whereas the whole area red solid image section Pr has a belt shape extending in the sub scanning direction over a recording sheet in a region where he black solid image section Pk is absent having an image area rate of 10% in the main scanning dire in sections.

Then, such a test image is outputted, and colors on respective sections indicated by alpha and beta in a red solid image section Pr are detected by a reflection spectroscopic density meter X-Rite938. The alpha section only has a red solid image section Pr extending in the sub scanning direction over the entire recording sheet excluding the black solid image section Pk. The beta section is the red solid section on the recording sheet having the red and black solid image sections Pk and Pr on the entire recording sheet when viewed in the sub scanning direction.

As a result of measuring the color, an L star value of the alpha section indicates 46.3, and that of the beta section indicates 46.9, so that a difference therebetween can be minimized to be only 0.6. Further, image density ID of the black solid image section Pk indicates 165 regardless of a position in the sub scanning direction.

To obtain a comparative example, a similar test image is outputted by simply executing the below described constant current control without using the first to tenth formulas, specifically, regardless of an average image area rate on a photoconductor, const current control is applied to maintain primary transfer currents of Y, M, C, and Bk colors to be 29 micro Ampere, 25 micro Ampere, 22 micro Ampere, and 23 micro Ampere, respectively. Then, colors are measured in a similar manner as executed in the above-described experiment, and brightness values L of the alpha and beta sections indicate 46.9 and 48.0, respectively. Thus, the difference of those brightness values amounts to 1.1 and is almost twice as much as that in the above-described experiment, and thereby causing such color unevenness, because the alpha section is obtained first by transferring the Y color toner solid section onto a belt at the Y color primary transfer nip, and transferring the M color toner solid section thereon at the M color primary transfer nip, and then conveying it through primary transfer nips of C and Bk colors sequentially. Specifically, the M color toner included in the M color toner solid image section on the belt is partially transferred back onto the photoconductor in the above-described primary transfer nips, and the brightness L of the alpha section is increased from an initial amount.

Subsequently, another experiment of outputting a whole area solid image extending over a recording sheet under two different conditions is simply executed (i.e., the same current target amount for each color as in the above-described experiment), in which the first to tenth formulas are used in the constant current control.

Initially, a whole area solid green image is obtained by transferring C color whole area solid section onto a Y color whole area solid section and is similarly tested as descried in the above experiment. A whole area solid red image is then obtained by transferring M color whole area solid section onto a Y color whole area solid section and is similarly tested.

As a result of measuring color of the whole area green solid image, values of L star, alpha star, and beta star indicate 42.8, 58.9 and 23.0, respectively, under the condition in that the first to tenth formulas are used. By contrast, they are 44.5, 58.3, and 23.1, respectively, under the simple constant current control. Specifically, in the former condition according to one embodiment of the present invention, a lower brightness image can be obtained than in the latter condition, because as a result of minimizing the reverse transfer of Y and C color toner particles at the primary transfer nips of the M and Bk colors, much more amount of toner particles is attracted to the recording sheet on the former condition than the latter condition.

Further, color measuring result of the red whole area solid image performed under the condition in that the first to tenth formulas are used indicates that values of L star, alpha star, and beta star amount to 47.7, 62.5, and 45.1, respectively. By contrast, they are 48.1, 62.0 and 47.3, respectively, under the simple constant current control. Specifically, in the former condition as one embodiment of the present invention, a lower brightness image can be obtained than in the latter condition for the same reason as described above.

Figure 12:
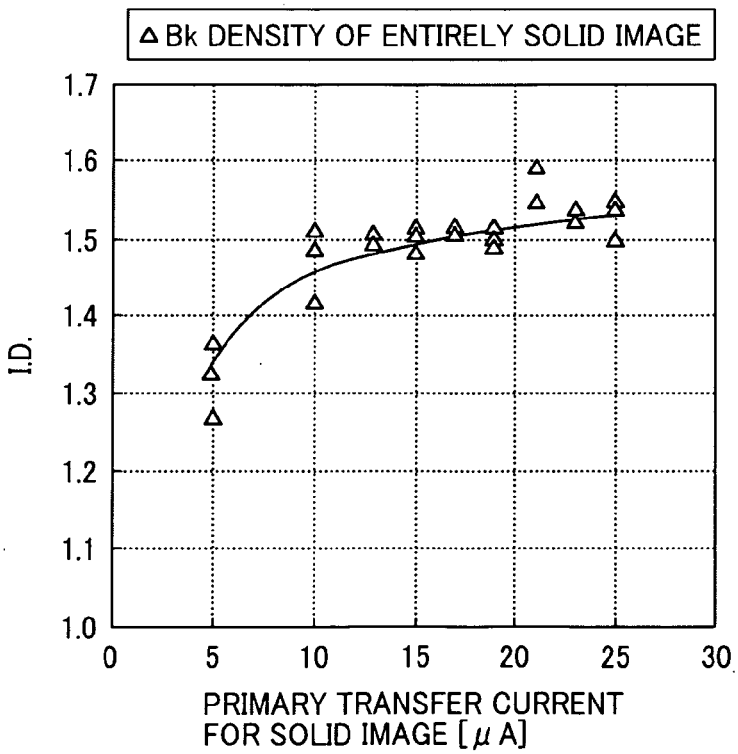
FIG. 12 illustrates a relation between an average image density within a whole area solid image of Bk color and a primary transfer current.

Yet another test of measuring an average image density ID within a Bk whole area solid image outputted is performed by changing a primary transfer current while applying constant current control thereto, and an exemplary relation between an average image density within the Bk whole area solid image and a primary transfer current is obtained as illustrated in FIG. 12. As shown, it is confirmed that when a primary transfer current is slightly higher than 20 micro Ampere, the average density increases and the unevenness of image density recognized with eye checking can be minimized, especially in an apparatus having large left and right side deviation and unevenness of toner attraction. When an amount of current is decreased simply in accordance with an image area rate based on the sixth formula, the primary transfer current IK(× 4=100%) becomes 17 micro Ampere, so that the density sometimes becomes uneven when multiple bad conditions, such as shortage of an amount of attracted toner on a photoconductor, etc., simultaneously occur. However, it is confirmed that a whole area solid image having even density can be steadily outputted when a primary transfer current IK(× 4=100%) is increased to 20 micro Ampere.

As described heretofore, according to one embodiment of the present invention, a target amount of a constant current control is changed in accordance with an average image area rate on a photoconductor in the primary transfer nip exit, and such a control is hereinafter referred to as dynamic transfer current control (DTCC).

In the DTCC, when a target amount of a primary transfer current is determined in accordance with an average image area rate on a photoconductor at a primary transfer nip exit, an image area rate of as toner image carried on an intermediate transfer belt 21 at the transfer nip exit is neglected for the below described reason.

That is, a primary transfer voltage automatically increases within an appropriate range capable of minimizing reverse toner transfer and a fine image is finally obtained without considering the image area rate of the toner image on the intermediate transfer belt 21 when the toner image exists thereon.

However, according to a conventional image forming apparatus as described in Japanese Patent Application Laid Open No 2003-186284, a target amount of a primary transfer current is determined based on rates of an overlapping image and an image, which is obtained by subtracting an overlap of the previous and post transfer toner images on an intermediate transfer belt from the sum thereof. In such a configuration, a large amount of transfer current flows at a section other than the overlap, so that a reverse transfer rate increases resulting in significant deterioration of image density.

Figure 18:
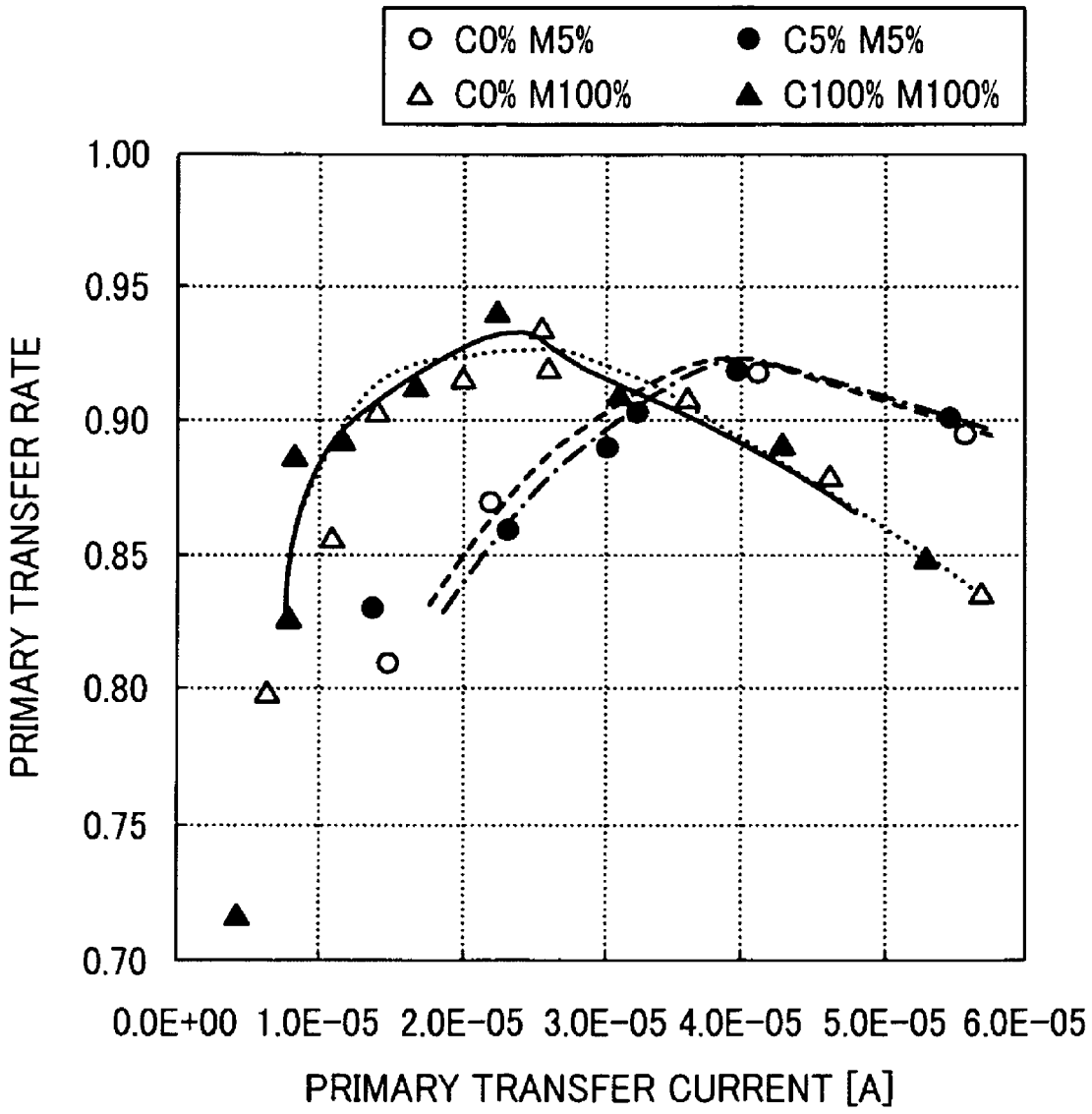
FIG. 18 illustrates an exemplary relation between a primary transfer current, a primary transfer rate, and a condition of toner intervening in a primary transfer nip in the printer of FIG. 17.

Further, as apparent from a graph of FIG. 8 and a later described first modification with reference to FIG. 18, the transfer current does not need to be largely increased when toner images are transferred and superimposed, because tendency of a curve of a transfer efficiency showing dependency onto transfer current is the same as that in a monochrome color image formation. The conventional image forming apparatus further needs a large capacity memory or a high performance CPU to store print position information per color to determine the overlap and an overlap rate. By contrast, according to the printer of one embodiment of the present invention, a high quality image can be reproduced at low cost due to solely controlling a transfer current in accordance with an image area rate of a toner image to be transferred Further, a conventional primary transfer bias control system executes, beside typical constant current and voltage systems, an active transfer voltage control (ATVC) and a programmable transfer voltage control (PTVC) as described in Japanese Patent Application Laid Open Nos. 2-123385 and 5-181373, respectively.

Such conventional systems are all constant voltage control types that control an output current to cause an output voltage to be a target amount. When an electric resistance changes as environment changes, a preferable amount of an output voltage changes accordingly. Thus, these types are different from a general constant voltage control type in that a target amount is changes in accordance with a measured result of the resistance of a primary transfer roller at every prescribed times. Specifically, the ATVC controls a current to be constant while the PTVC controls voltage to be constant when the resistance of the printer is measured. Since the same amount is employed as a target amount all in the first and second and subsequently colors in any of systems, toner on the belt is transferred back on to a background thereof at the primary transfer nips of the second and subsequently colors.

Further, the target amount of the output voltage is corrected at every prescribed times based on the measured amount of the resistance of the printer. However, when the resistance sharply changes due to sharp change in environment, the corrected amount does not reflect current condition immediately. In such a situation, when the resistance measuring time interval is shortened to minimize such a problem, a machine downtime increases. By contrast in one embodiment of the present invention, since a current amount is controlled to be constant, a prescribed amount of current is supplied, and accordingly a transfer performance can be stable regardless of the change in resistance of the printer.

Further, a target amount of a primary transfer current for each of the respective colors of M to Bk designated when an average image area rate is 0% is smaller than that designated when an average image area rate is 100% as shown in FIG. 10. Accordingly, minimization of the reverse transfer is given priority when the average image area rate is 0%, while improvement of the transfer efficiency is given priority when the average image area rate is 100%.

Figure 13:
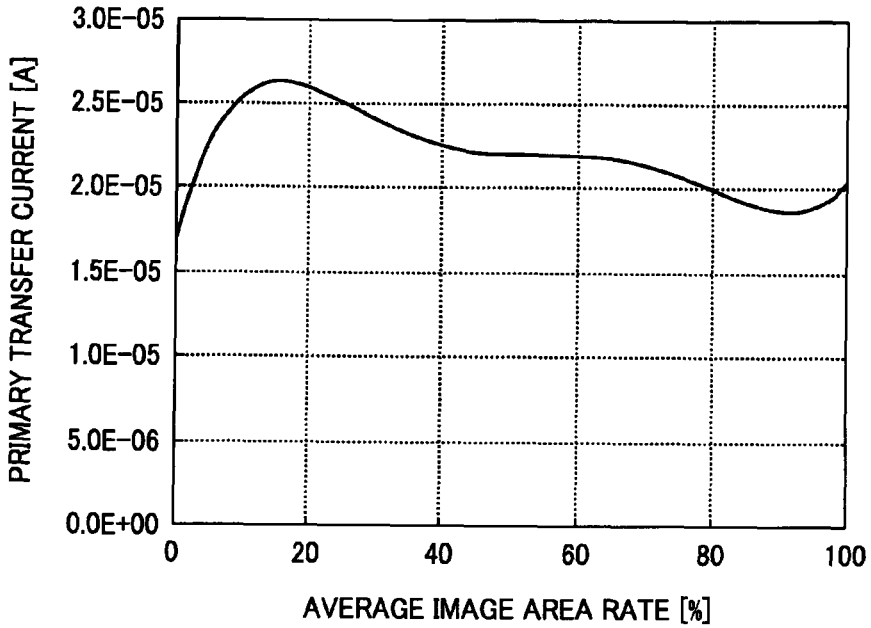
FIG. 13 illustrates a second exemplary relation between a target amount of a primary transfer current and an average image area rate per color.

The relation between the average image area rate and the target amount of the primary transfer current is not limited to that described with reference to FIG. 10, but can include the other relations as shown in FIGS. 13 to 16. For example, FIG. 13 illustrates a curved graph indicating multiple functions other than a linear graph of the linear function.

Figure 14:
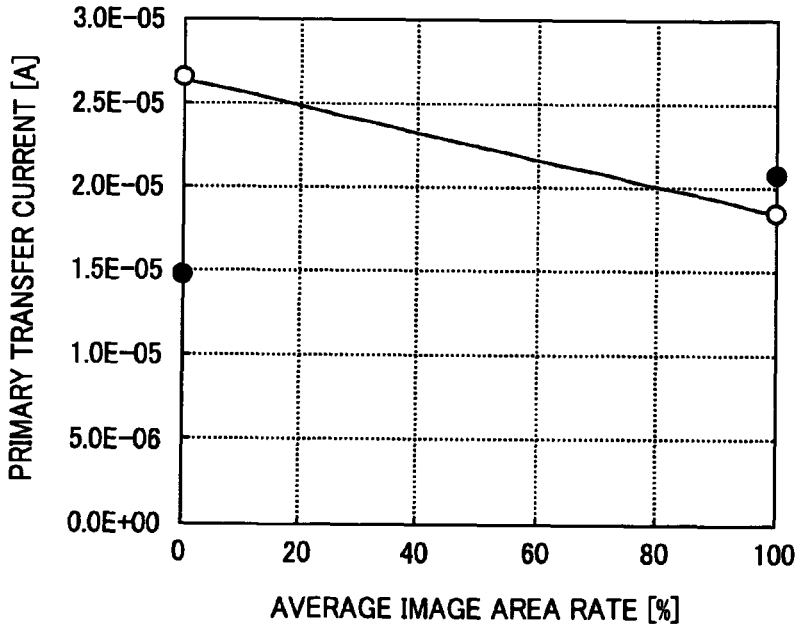
FIG. 14 illustrates a third exemplary relation between a target amount of a primary transfer current and an average image area rate per color.

FIG. 14 illustrates a linear graph of the linear function meeting the following equalities. As shown, the linear graph is a first algorithm used when an average image area rate ranges from 1 to 99%. When an average image area rate is less than 1%, for example 0%, 15 micro Ampere is employed as a target amount as a second algorithm. When an average image area rate is more than 99%, for example 100%, 21 micro Ampere is used as a target amount as a third algorithm.

Figure 15:
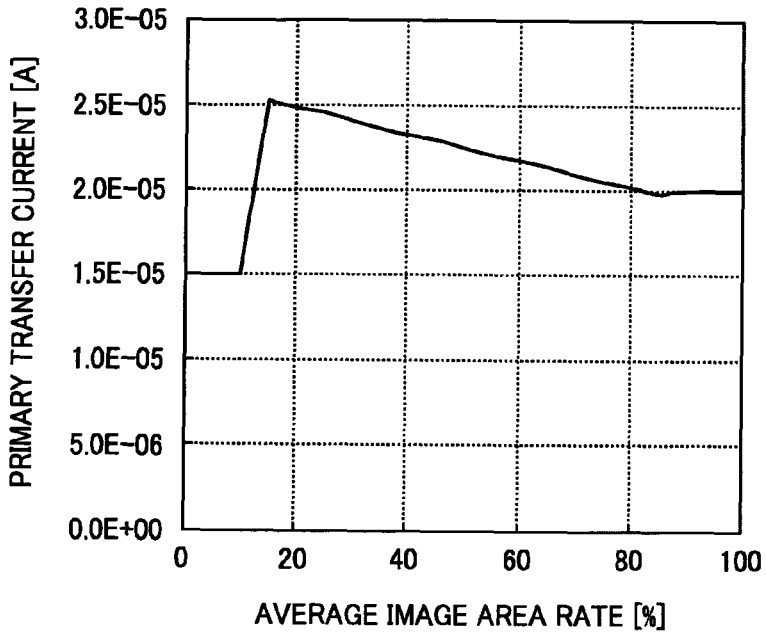
FIG. 15 illustrates a fourth exemplary relation between a target amount of a primary transfer current and an average image area rate per color.
Figure 16:
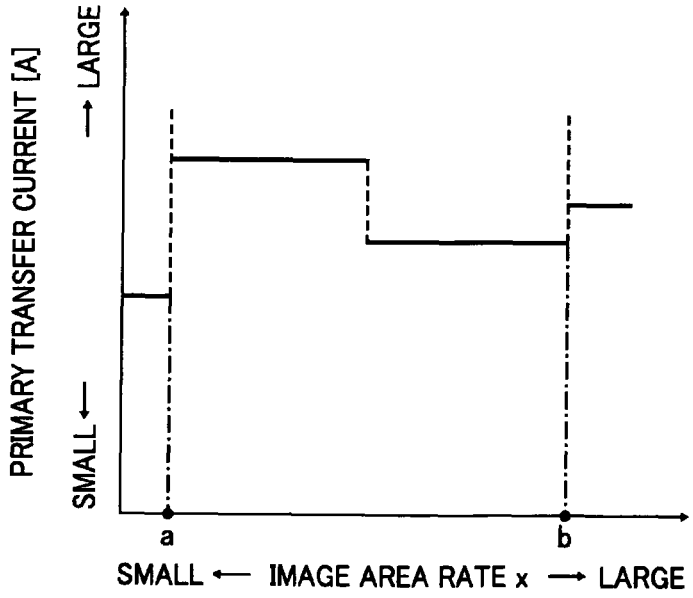
FIG. 16 illustrates a fifth exemplary relation between a target amount of a primary transfer current and an average image area rate per color.

FIG. 15 illustrates yet another relation between an average image area rate and a target amount with almost a complex line graph. In FIG. 16, a target amount is changed step by step rather than consecutively changing thereof in regard to an image area rate consecutively changing within the range of a to b %. For such an algorithm, a data table can be employed beside a function formula.

Heretofore, although the exemplary system that changes a target amount of a primary transfer current in accordance with an average image area rate of a ten line compartment, the present invention is not limited thereto and can employ various modifications each calculates an image area rate per various numbers of pixels such as one, a hundred, etc. Further, the target amount can be gradually changed at a transition to the next 10 or less or more pixel compartment without sharply changing thereof.

Although a target amount of a primary transfer current is decreased meeting the below described first relation (i.e., formula 1) if the average image area rate is the same, the relation of the present invention is not limited thereto and can include the below described second various relations (i.e., formula 2) as far as they meet the least condition in that the target amount is gradually decreased;

$$Y>M>C=K \tag{1}$$

$$Y>M=C=K, Y=M>C=K, Y>M>C>K \tag{2}$$

Further, various modifications of the printer having substantially the same configurations and functions as that in the above-described embodiment can be employed.

Figure 17:
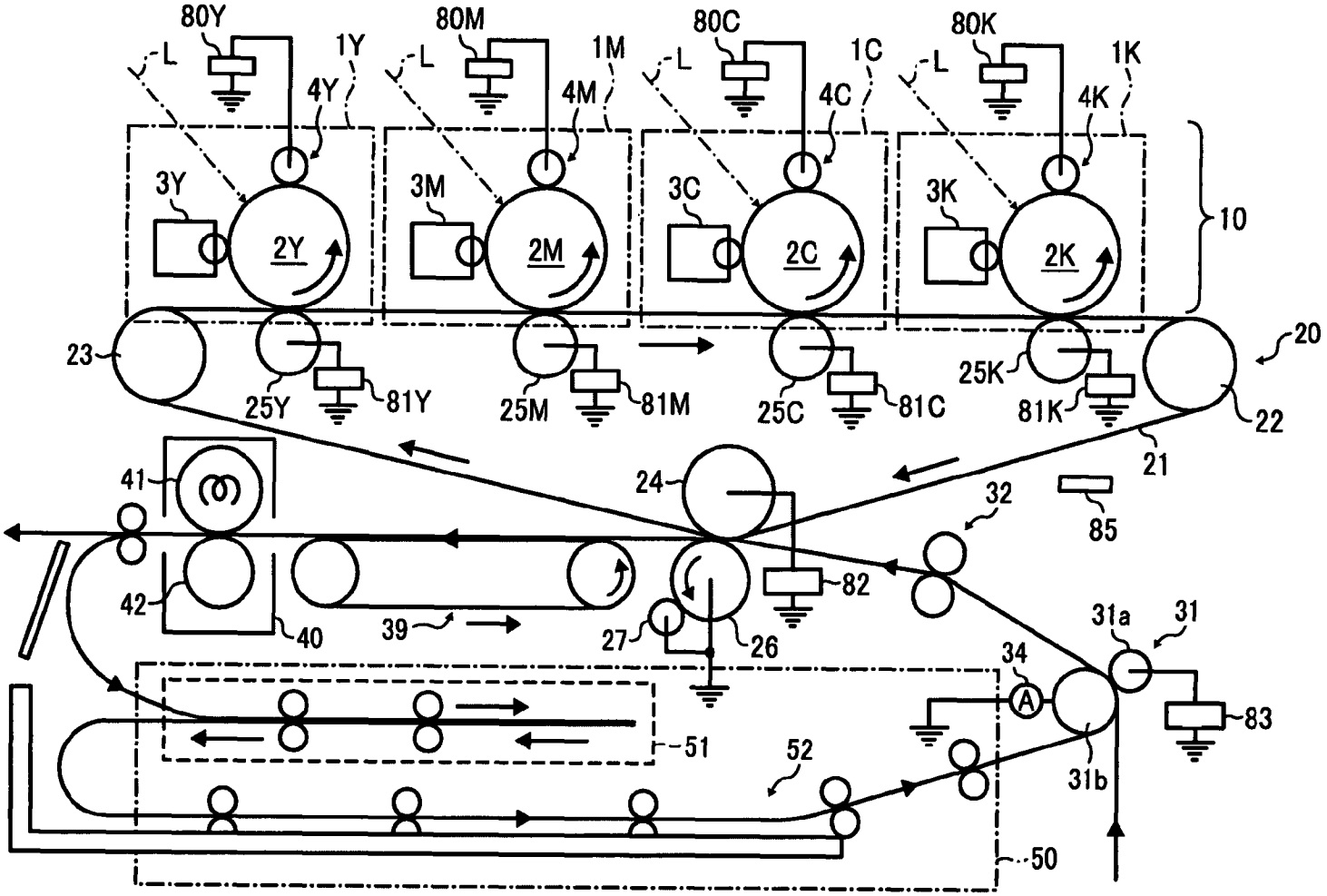
FIG. 17 schematically illustrates a first modification of the printer.

As shown in FIG. 17, a modified printer is only different from that in the above-described embodiment in that a recording sheet P is horizontally conveyed to carry images by a sheet conveyance system 50 and similar devices. FIG. 18 illustrates a result of a test executed by using the modification, in which an exemplary relation between a primary transfer current, a primary transfer rate, and a condition of toner intervening in a primary transfer nip in the printer. It is understood therefrom that the primary transfer current and the primary transfer rate are each largely effected by the image area rate, and is rarely effected by the toner attracted amount on the belt.

Figure 19:
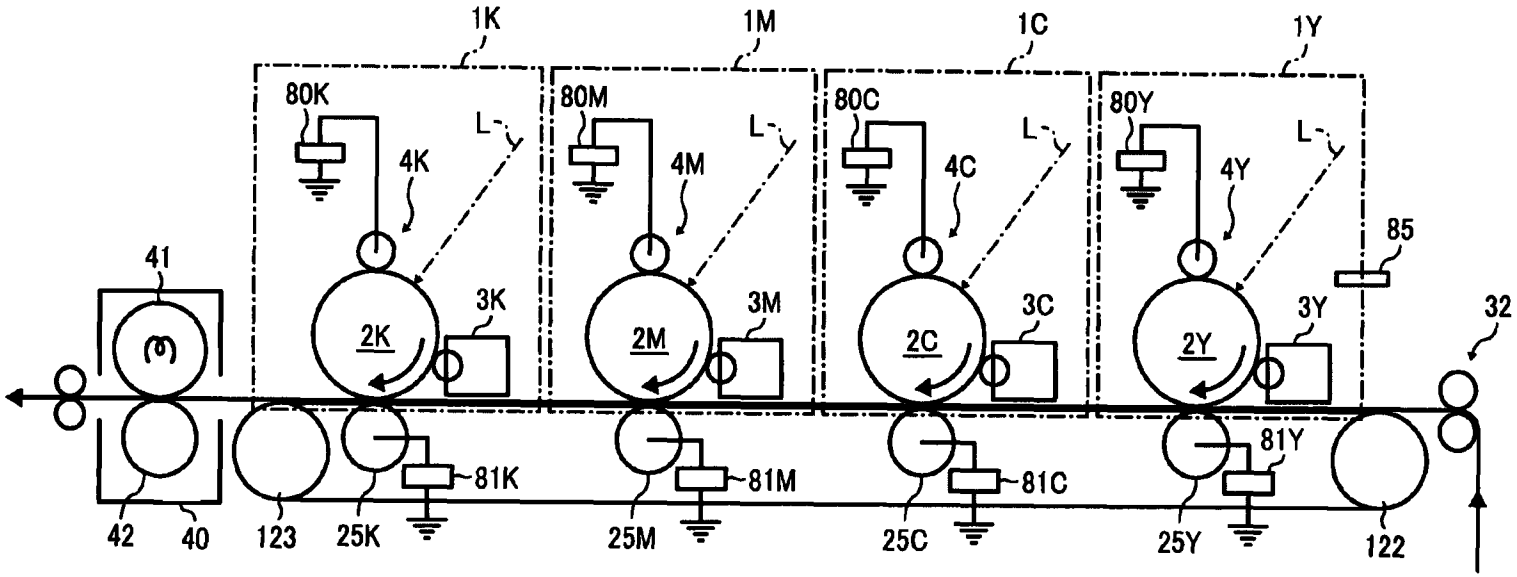
FIG. 19 schematically illustrates a second modification of the printer.

FIG. 19 illustrates a second modification of a printer, which is only different in that an endless sheet conveyance belt 121 is employed contacting photoconductors 2Y to 2Bk of respective colors instead of an intermediate transfer belt as a nip crating member. Specifically, the sheet conveyance belt 121 holds a recording sheet on its surface and conveys it through primary transfer nips of respective colors of M to Bk one by one while endlessly moving. During conveyance of the sheet conveyance belt 121, toner images of M to Bk colors carried on the photoconductors 2Y to 2Bk are transferred and superimposed on the recording sheet.

Figure 20:
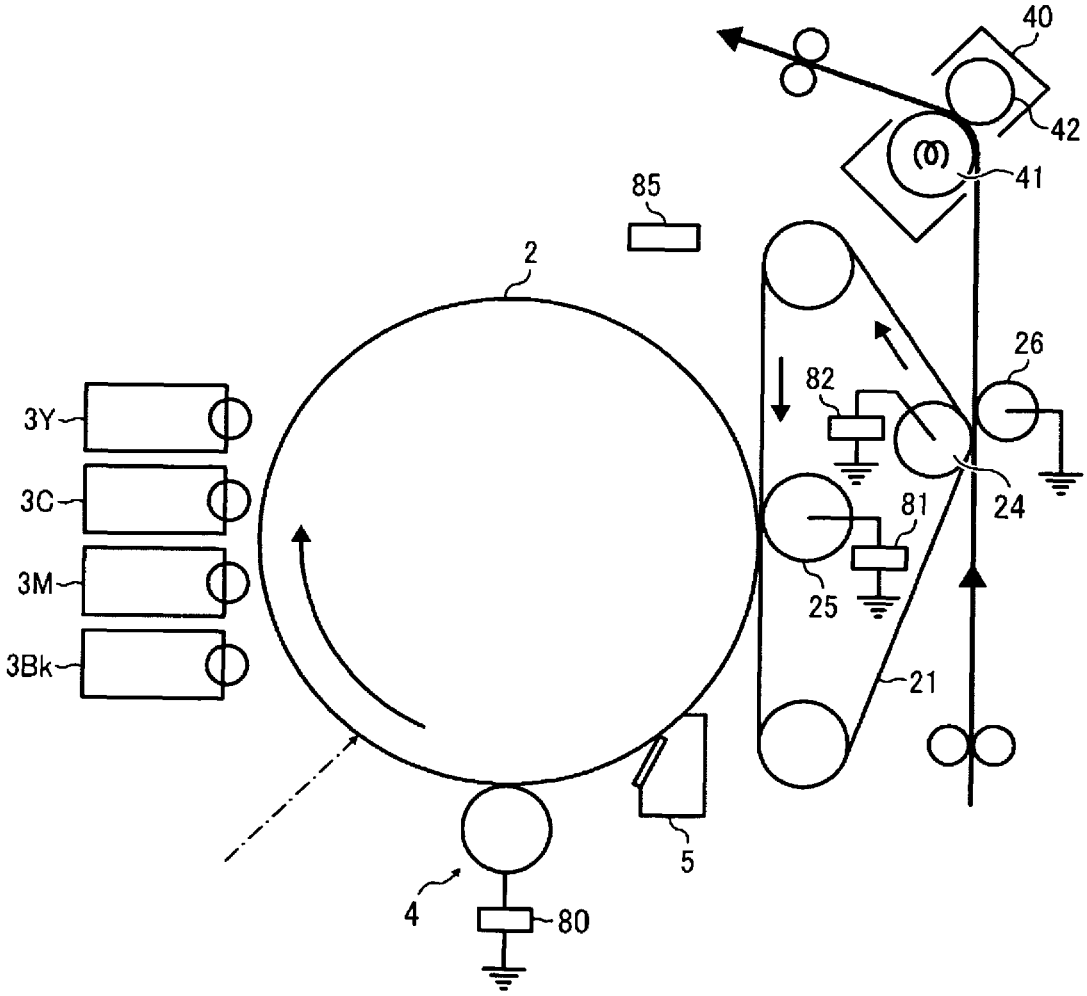
FIG. 20 schematically illustrates a third modification of the printer.

FIG. 20 also illustrates a third modification of the printer, which is only different in that multiple developing devices 3Y to 3Bk for Y to Bk colors are provided around one photoconductor.

Respective toner images are formed on the photoconductor 2 and are transferred and superimposed on an intermediate transfer belt 21 as a full-color image in primary transfer processes. Then, the full-color image is transferred onto a recording sheet at once in a secondary transfer process. In a first color transfer step (i.e., a first circulation) of the primary transfer process, the same algorithm as used in the above-described embodiment for Y color is used.

The same algorithm as used in the above-described embodiment for M color is used in second and subsequently circulations during the primary transfer processes.

According to one embodiment of the present invention, when an average image area rate exceeds a prescribed level (100>b=95%) in a primary transfer nip, a third algorithm including fourth, seventh, and tenth formulas is used to obtain a target vale for a primary transfer current for the range exceeding the prescribed level, which target level is larger than that obtained by the first algorithm including third, sixth, and ninth formulas when an average image area rate is 95%.

According to another embodiment of the present invention, a second algorithm including second, fifth, and eighth formulas increases a target vale for a primary transfer current as an average image area rate increases.

According to yet another embodiment of the present invention, a third algorithm including fourth, seventh, and tenth formulas increases a target vale for a primary transfer current as an average image area rate increases.

According to yet another embodiment of the present invention, a prescribed target amount obtained corresponding to the average image area rate of 0% is less than that obtained corresponding to that of 100% in the second and third algorithms.

According to yet another embodiment of the present invention, a target amount obtained corresponding to the average image area rate of 0% is minimized to a prescribed least value among those obtained corresponding to the other average image area rates in the first to third algorithms.

According to yet another embodiment of the present invention, one of first and second algorithms decreases a prescribed target amount as the image area rate increases in a range from zero to 100% and is used in the first transfer step.

According to yet another embodiment of the present invention, the second algorithm associates a smaller target amount with an image area rate in a second transfer step than that in the first transfer step.

Numerous additional modifications and variations of the present invention are possible in latent image of the above-described teachings. It is therefore to be understood that within the scope of the appended claims, the present invention may be practiced otherwise that as specifically described herein.

What is claimed is:

1. An image forming apparatus, comprising:

a latent image bearer configured to bear a latent image;

a developing device configured to develop a latent image on the latent image bearer with toner;

a nip creating member contacting the latent image bearer configured to create a transfer nip therebetween;

a transfer current providing device configured to provide a prescribed target amount of transfer current to the nip creating member, said transfer current transferring the toner image from the latent image bearer onto one of the nip creating member and a recording sheet conveyed by the nip creating member, an image area rate obtaining device configured to obtain an image area rate of the latent image borne on the image bearer in the vicinity of an exit of the transfer nip;

a determiner configured to determine a prescribed target amount of transfer current to be provided to the nip creating member based on one of at least two first and second algorithms, each of said at least two first and second algorithms representing a relation between the image area rate of the latent image borne on the image bearer in the vicinity of an exit of the transfer nip and a prescribed target amount of transfer current; and a process controller configured to execute a first transfer step, in which the toner image on the latent image bearer is transferred onto one of the nip creating member and the recording sheet for the first time, and a second transfer step, in which the toner image on the latent image bearer is transferred onto one of the nip creating member and the recording sheet already bearing a prescribed toner image thereon, wherein said first algorithm is utilized in the second transfer step when the image area rate falls within a typical range from the lower limit (a %) to the upper limit (b %), said first algorithm decreasing the prescribed target amount as the image area rate increases within the typical range, and wherein said second algorithm is utilized in the second transfer step in which the transfer current is applied when the toner image passes through the transfer nip based on the image area rate in a range corresponding to a predetermined line in a sub-scanning direction in the vicinity of the exit of the transfer nip and when the image area rate is less than the lower limit (a %) of the typical range, said second algorithm decreasing the target amount to be less than that obtained by the first algorithm when the image area rate is the lower limit (a %), wherein said lower limit (a %) is more than zero and said higher limit (b %) is greater than the lower limit (a %), and wherein the second algorithm controls the transfer current using the image area rate of a transfer station that transfers the toner image.

2. The image forming apparatus as claimed in claim 1, wherein a prescribed one of the at least two first and second algorithms is used in the first transfer step, said prescribed one of the at least two first and second algorithms decreasing the prescribed target amount as the image area rate increases in a range from zero to 100%.

3. The image forming apparatus as claimed in claim 1, wherein said second algorithm associates a smaller target amount with an image area rate in a second transfer step than that in the first transfer step.

4. The image forming apparatus as claimed in claim 1, further comprising a third algorithm utilized in the second transfer step when the image area rate is more than the upper limit (b %), said third algorithm increasing the prescribed target amount when the image area rate is more than the upper limit (b %), wherein said upper limit (b %) is less than 100%.

5. The image forming apparatus as claimed in claim 4, wherein said second algorithm increases the prescribed target amount as the image area rate increases.

6. The image forming apparatus as claimed in claim 5, wherein said third algorithm increases the prescribed target amount as the image area rate increases.

7. The image forming apparatus as claimed in claim 6, wherein a prescribed target amount obtained corresponding to the average image area rate of 0% is less than that obtained corresponding to that of 100% in said second and third algorithms.

8. The image forming apparatus as claimed in claim 7, wherein a target amount obtained corresponding to the average image area rate of 0% is reduced to a minimum among those obtained corresponding to the other average image area rate in the first to third algorithms.

* * * * *